US007274342B2

(12) United States Patent
Onozawa et al.

(10) Patent No.: US 7,274,342 B2
(45) Date of Patent: Sep. 25, 2007

(54) DRIVE CIRCUIT AND PLASMA DISPLAY DEVICE

(75) Inventors: Makoto Onozawa, Kawasaki (JP); Shigetoshi Tomio, Kawasaki (JP); Tetsuya Sakamoto, Kawasaki (JP); Katsumi Itoh, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 608 days.

(21) Appl. No.: 10/917,399

(22) Filed: Aug. 13, 2004

(65) Prior Publication Data

US 2005/0134531 A1 Jun. 23, 2005

(30) Foreign Application Priority Data

Dec. 22, 2003 (JP) ..... 2003-425666

(51) Int. Cl.
*G09G 3/28* (2006.01)

(52) U.S. Cl. ..... 345/60; 345/211

(58) Field of Classification Search ..... 345/60–68, 345/211; 315/169.4
See application file for complete search history.

(56) References Cited

U.S. PATENT DOCUMENTS 6,483,487 B2 * 11/2002 Iseki ..... 345/60
6,686,912 B1 * 2/2004 Kishi et al. ..... 345/211
7,193,586 B2 * 3/2007 Lee et al. ..... 345/60
2002/0097203 A1 7/2002 Onozawa et al.

FOREIGN PATENT DOCUMENTS

EP 1 065 650 A2 1/2001

* cited by examiner

*Primary Examiner*—Kevin M. Nguyen
(74) *Attorney, Agent, or Firm*—Stass & Halsey LLP

(57) ABSTRACT

A first signal line for supplying a potential to one terminal of a capacitive load, a first switch element for supplying a first potential to the first signal line, a first drive circuit for driving the first switch element, and a second signal line for supplying a second potential different from the aforesaid first potential to the one terminal of the capacitive load are included. A first capacitor is capable of supplying a lower potential than the first and the third potentials to the first signal line. A coil circuit is connected between the first signal line or the second signal line and a supply line for supplying the third potential. A floating power supply circuit supplies power supply voltage with a potential of the first signal line as a reference to the first drive circuit.

24 Claims, 18 Drawing Sheets

DRIVE CIRCUIT AND PLASMA DISPLAY DEVICE

CROSS-REFERENCE TO RELATED APPLICATIONS

This application is based upon and claims the benefit of priority from the prior Japanese Patent Application No. 2003-425666, filed on Dec. 22, 2003, the entire contents of which are incorporated herein by reference.

BACKGROUND OF THE INVENTION

1. Field of the Invention

The present invention relates to a drive circuit and a plasma display device.

2. Description of the Related Art

In an AC-driven type plasma display panel (Plasma Display Panel: PDP) which is one of plasma display devices, there are two-electrode type PDPs which perform selective discharge (address discharge) and sustain discharge with two electrodes, and three-electrode type PDPs which perform address discharge by using a third electrode. In the above-described three-electrode type PDPs, there are the case in which the third electrode is formed on the substrate on which the first electrode and the second electrode for performing sustain discharge are placed, and the case in which the third electrode is formed on another substrate opposite to the substrate.

Since each of the above described types of PDP devices is based on the same operation principle, the constitution example of the PDP device in which first and second electrodes which perform the sustain discharge are provided on a first substrate, and a third electrode is separately provided on a second substrate opposite to the first substrate will be explained hereinafter.

FIG. 13 is a diagram showing an entire constitution of an AC-driven type PDP device. In FIG. 13, an AC-driven type PDP device 1 includes a panel P having a plurality of cells disposed in a matrix form with each cell being as one pixel of a display image. More specifically, a cell Cmn which is in the m-th column and the n-th row of the matrix, as shown in FIG. 13. The AC-driven type PDP device 1 is provided with scanning electrodes Y1 to Yn parallel to each other and common electrodes X formed on a first substrate, and address electrodes A1 to Am formed on a second substrate opposite to the above-described first electrode so as to be in a perpendicular direction to the electrodes Y1 to Yn and X. The common electrodes X are disposed close to the respective corresponding scanning electrodes Y1 to Yn, and are commonly connected to each other at one terminal.

The common terminal of the above-described common electrodes X are connected to an output terminal of an X-side circuit 2, and the scanning electrodes Y1 to Yn are connected to output terminals of a Y-side circuit 3. The address electrodes A1 to Am are connected to output terminals of an address side circuit 4. The X-side circuit 2 is constituted of a circuit that repeats a discharge, and the Y-side circuit 3 is constituted of a circuit that performs line-sequential scan and a circuit that repeats a discharge. The address-side circuit 4 is constituted of a circuit that selects a line to be displayed.

These X-side circuit 2, Y-side circuit 3 and address-side circuit 4 are controlled with control signals supplied from a drive control circuit 5. Namely, the address-side circuit 4 and the circuit for performing line-sequential scan inside the Y-side circuit 3 determine which cells are to be lit, and the display operation of the PDP device is performed by repeating discharges of the X-side circuit 2 and the Y-side circuit 3.

The drive control circuit 5 generates the above-described control signals on the basis of display data D from an outside, a clock CLK representing read timing for the display data D, a horizontal synch signal HS and a vertical synch signal VS, and supplies the control signals to the X-side circuit 2, the Y-side circuit 3 and the address-side circuit 4. According to the constitution shown above, the AC-driven type PDP device 1 controls flashing of each cell and can display an image on the Panel P.

Here, a structure of each cell of the AC-driven type PDP device 1 shown in FIG. 13 will be explained. FIGS. 14A to 14C are diagrams showing the structure of the cell included in the AC-driven type PDP device 1 shown in FIG. 13. FIG. 14A is a diagram showing a cross-sectional constitution of a cell Cij as one pixel, which is in the i-th row and the j-th column. In FIG. 14A, a common electrode X and a scanning electrode Yi are formed on a front glass substrate 11. This is coated with a dielectric layer 12 for insulating the electrodes from a discharge space 17, and the resultant structure is further coated with an MgO (magnesium oxide) protective film 13.

Meanwhile, an address electrode Aj is formed on a back glass substrate 14 disposed opposite to the front glass substrate 11, and the address electrode Aj is coated with a dielectric layer 15. The dielectric layer 15 is coated with fluorescent substances 18. The discharge space 17 between the MgO protective film 13 and the dielectric layer 15 is charged with Ne+Xe Penning gas or the like.

FIG. 14B is a diagram for explaining a capacitance Cp of the AC-driven type PDP device. As shown in FIG. 14B, in the AC-driven type PDP device, capacitance components Ca, Cb and Cc exist in the discharge space 17, between the common and scanning electrodes X and Y, and in the front glass substrate 11, respectively, and the capacitance Cp cell per cell (Cp cell=Ca+Cb+Cc) is determined by the sum of them. The total of the capacitances Cp cell of all cells is the panel capacitance Cp.

FIG. 14C is a diagram for explaining light emission of the AC-driven type PDP device. As shown in FIG. 14C, the fluorescent substances 18 of red, blue and green are applied to be arranged in each color in stripes onto an inner surface of a rib 16. The fluorescent substances 18 are excited by a discharge between the common and scanning electrodes X and Y to emit a light 19.

Next, an operation of the AC-driven PDP device 1 shown in FIG. 13 will be explained by using a waveform diagram.

FIG. 15 is a waveform diagram showing the operation of the AC-driven type PDP device 1 shown in FIG. 13. FIG. 15 shows an example of waveforms of voltage which is applied to the X, Y and address electrodes in one subfield out of a plurality of subfields constituting one frame. One subfield is divided into a reset period constituted of a full writing period and a full erasing period, an address period, and a sustain discharge (sustain) period.

First, in the reset period, the voltage applied to the common electrodes X is lowered to (−Vs/2) from the ground level. On the other hand, as for the voltage applied to the scanning electrodes Y, the voltage which is the resultant voltage of adding up the voltage Vw and the voltage (Vs/2) is applied to the scanning electrodes Y. At this time, the voltage (Vs/2+Vw) gradually rises with a lapse of time. As a result, the potential difference between the common electrodes X and the scanning electrodes Y becomes (Vs+Vw), and discharge occurs in every cell of every display line to generate wall charges, irrespective of the preceding display state (full writing).

Next, after the voltage of the common electrodes X and the scanning electrodes Y is returned to the ground level, the applied voltage to the common electrodes X is raised to (Vs/2) from the ground level, and the applied voltage to the scanning electrodes Y is dropped to (−Vs/2). As a result, the voltage by the wall charges themselves exceeds the discharge start voltage in every cell, and discharge is started. At this time, the stored wall charges are erased by the applied voltage to the common electrodes X as described above (full erasing).

Next, in the address period, address discharge is line-sequentially performed to turn each cell ON/OFF in accordance with the display data. At this time, a voltage (Vs/2) is applied to the common electrodes X. When a voltage is applied to the scanning electrode Y corresponding to a certain display line, the voltage at a level of (−V2/2) is applied to the scanning electrodes Y that are selected line-sequentially, and the voltage at the ground level is applied to the scanning electrode Y that are not selected.

At this time, an address pulse having a voltage Va is selectively applied to an address electrode Aj corresponding to a cell to undergo sustain discharge, that is, to be turned ON, in the address electrodes A1 to Am. As a result, discharge occurs between the address electrode Aj to be turned ON and the scanning electrode Y that is selected line-sequentially. With this being as priming (pilot), discharge between the common electrodes X and the scanning electrodes Y starts immediately. Wall charges in such an amount as to enable the next sustain discharge are stored on the surface of the MgO protective film on the common electrode X and the scanning electrode Y of the selected cell.

Thereafter, in the sustain discharge period, the voltage of the common electrodes X gradually rises by the operation of the power recovering circuit which will be described later. Subsequently, in the vicinity of the peak of the rise, the voltage of the common electrodes X is clamped to (Vs/2).

Next, the voltage of the scanning electrodes Y gradually drops. At this time, the power recovering circuit recovers part of the charges. The operation of the power recovering circuit will be described later. In the vicinity of the peak of the drop, the voltage of the scanning electrodes Y is clamped to (−V2/2). Similarly, when the applied voltage to the common electrodes X and the scanning electrodes Y is raised to the ground level (0V) from the voltage (−Vs/2), the applied voltage is gradually raised. In the scanning electrodes Y, the voltage (Vs/2+Vx) is applied only when high voltage is applied initially. The voltage Vx is the added voltage to generate necessary voltage for sustain discharge, which is the addition of the voltage of the wall charges generated in the address period shown in FIG. 15.

When the applied voltage to the common electrodes X and the scanning electrodes Y is lowered to the ground level (0V) from the voltage (Vs/2), the applied voltage is gradually lowered and part of the charges stored in the cells is recovered into the power recovering circuit.

Thus, in the sustain discharge period, the voltages (+Vs/2, −Vs/2) differing in polarity from each other are alternately applied to the common electrodes and the scanning electrode Y in each display line to perform sustain discharge, and an image of one subfield is displayed. The operation of alternate application is called a sustain operation, and the detailed operation will be explained by using FIG. 18 that will be described later.

In each cell of the AC-driven type PDP device, the capacitance components exist in the discharge space of each cell, between the common and scanning electrodes X and Y, and in the front glass substrate, respectively, and the capacitance per one cell is determined by the total of them. The fluorescent substances of red, blue and green are applied to be arranged in each color in stripes onto inner surfaces of the cells of the AC-driven PDP device. The fluorescent substances are excited by the discharge between the common and scanning electrodes X and Y to emit light.

However, the aforementioned X-side circuit 2 and the Y-side circuit 3 (hereinafter, called drive circuits) are circuits for outputting signals at high voltage to cause discharge inside the cells, and therefore each element constituting the drive circuits is required high voltage resistance, which causes an increase in the manufacturing cost. Thus, there is proposed the art of simplifying the circuit constitution and reducing the manufacturing cost by reducing the withstand voltage of each element included in the aforesaid drive circuits. There is proposed a drive circuit which performs discharge between the electrodes by utilizing the potential difference between the electrodes, for example, by applying a positive voltage to one electrode and a negative voltage to the other electrode (for example, the following Patent Document 1). This circuit is called a TERES (Technology of Reciprocal Sustainer) circuit.

A schematic constitution and an operation of the aforementioned TERES circuit will be explained hereinafter.

FIG. 16 is a diagram showing a schematic constitution of a drive circuit of the AC-driven type PDP device 1 shown in FIG. 13 (only the X-side circuit 2 is shown, the Y-side circuit 3 is omitted because it has the same constitution and operation).

In FIG. 16, a capacitive load 20 (hereinafter, called "load") is the total capacitance of the cell Cmn formed between one common electrode X and one scanning electrode Y. The common electrode X and the scanning electrode Y are formed in the load 20. Here, the scanning electrode Y means an optional scanning electrode in a plurality of scanning electrodes Y1 to Yn.

First, in the common electrode X side, switches SW1 and SW2 are connected in series between a power supply line (power source line) of the voltage (Vs/2) supplied from a power source and the ground (GND). One terminal of a capacitor C1 is connected to an interconnection point of the above-described two switches SW1 and SW2, and a switch SW3 is connected between the other terminal of the capacitor C1 and the ground. A signal line connected to the one terminal of the capacitor C1 is set as a first signal line OUTA, and a signal line connected to the other terminal is set as a second signal line OUTB.

Switches SW4 and SW5 are connected in series to both terminals of the above-described capacitor C1. An interconnection point of the two switches SW4 and SW5 is connected to the common electrode X of the load 20 via an output line OUTC, and is also connected to a power recovering circuit 21. The power recovering circuit 21 includes two coils L1 and L2 connected to the load 20, a switch SW6 connected in series to the one coil L1, and a switch SW7 connected in series to the other coil L2. Further, the power recovering circuit 21 includes a capacitor C2 connected between an interconnection point of the above-described two switches SW6 and SW7 and the second signal line OUTB.

A two-system series resonant circuit is constructed by the above-described capacitive load 20 and the respective coils L1 and L2 connected to the capacitance load 20. Namely, this power recovering circuit 21 has a two-system L-C resonant circuit, and recovers the charges, which are supplied to the panel P by the resonance of the coil L1 and the load 20, by the resonance of the coil L2 and the load 20.

The aforementioned switches SW1 to SW7 are controlled by control signals respectively supplied from the drive control circuit 5 shown in FIG. 13. As described above, the drive control circuit 5 is constituted by using a logical circuit and the like, generates the above-described control signals on the basis of the display data D supplied from the outside, the clock CLK, the horizontal synch signal HS, the vertical sync signal VS and the like, and supplies the control signals to the switches SW1 to SW7. As described above, the period in which the common electrode X and the scanning electrode Y in the cell discharge is called the sustain discharge period.

FIG. 18 is a time chart showing a driving waveform of the sustain discharge period by the drive circuit of the AC-driven type PDP device 1 constituted as in the above-described FIG. 16.

In the sustain discharge period, in the common electrode X side, the switches SW1, SW3 and SW5 are turned on first, and the remaining switches SW2, SW4, SW6 and SW7 are turned OFF. At this time, the voltage of the first signal line OUTA (first potential) becomes (+Vs/2), and the voltage of the second signal line OUTB (second potential) and the voltage of the output line OUTC become the ground level (t1).

Next, by turning ON the switch SW6 in the power recovering circuit 21, L-C resonance occurs with the coil L1 and the capacitance of the load 20, and the charges recovered in the capacitor C2 is supplied to the load 20 via the switch SW6 and the coil L1 (t2). By such a flow of the current, the voltage of the output line OUTC which is applied to the common electrode X gradually rises as shown in the times t2 to t3 in FIG. 18. The switch SW5 is turned OFF at the time t2.

Next, by turning ON the switch SW4 in the vicinity of the peak voltage occurring at the resonance time, the voltage of the output line OUTC which is applied to the common electrode X is clamped to (Vs/2) (t3). At the time t3, the switch SW6 is turned OFF.

When the voltage of the output line OUTC which is applied to the common electrode X is lowered to the ground level (0V) from (Vs/2), the switch SW7 is turned ON first, and the switch SW4 is turned OFF (t4). As a result, the L-C resonance occurs with the coil L2 and the capacitance of the load 20, and part of the charges stored in the load 20 is recovered into the capacitor C2 in the power recovering circuit 21 via the coil L2 and the switch SW7. By such a flow of the current, the voltage of the output line OUTC which is applied to the common electrode X gradually lowers as shown in the times t4 to t5 in FIG. 18.

Next, by turning ON the switch SW5 in the vicinity of the peak voltage (peak in the minus direction) which occurs at the resonance time, the voltage of the output line OUTC which is applied to the common voltage X is clamped to (−Vs/2) (t5). The switch SW7 is turned OFF at the time t5.

Next, the switches SW1, SW3 and SW5 are turned OFF, and the switches SW2 and SW4 are turned ON. At this time, the switches SW6 and SW7 are kept OFF. As a result, the voltage of the first signal line OUTA becomes the ground level, and the voltage of the second signal line OUTB and the output line OUTC becomes (−Vs/2) (t6).

Next, by turning ON the switch SW7 in the power recovering circuit 21, the L-C resonance occurs with the coil L2 and the capacitance of the load 20, and the charges (minus side) recovered in the capacitor C2 are supplied to the load 20 via the switch SW7 and the coil L2 (t7). By such a flow of the current, the voltage of the output line OUTC, which is applied to the common electrode X, gradually lowers as shown in the times t7 to t8 in FIG. 18. The switch SW4 is turned OFF at the time t7.

Next, by turning ON the switch SW5 in the vicinity of the peak voltage (peak in the minus direction) which occurs in this resonance time, the voltage of the output line OUTC which is applied to the common electrode X is clamped to (−Vs/2) (t8). At the time t8, the switch SW7 is turned OFF.

When the voltage of the output line OUTC, which is applied to the common electrode X, is raised to the ground level (0V) from (−Vs/2), the switch SW6 is turned ON first, and the switch SW5 is turned OFF (t9). As a result, the L-C resonance occurs with the coil L1 and the capacitance of the load 20, and part of the charges stored in the load 20 is recovered into the capacitor C2 inside the power recovering circuit 21 via the coil L1 and the switch SW6. By such a flow of the current, the voltage of the output line OUTC that is applied to the common electrode X gradually rises as shown in the times t9 to t10 in FIG. 18.

Next, by turning ON the switch SW4 in the vicinity of the peak voltage that occurs at the time of the resonance, the voltage of the output line OUTC, which is applied to the common electrode X, is clamped to the ground level (t10). The switch SW6 is turned OFF at the time t10. By the operation as described above, the drive circuit shown in FIG. 16 applies the voltage, which changes from −Vs/2 to Vs/2, to the common electrode X during the sustain discharge period. The voltage (+Vs/2, −Vs/2) with a different polarity from the voltage which is supplied to the aforementioned common electrode X is alternately applied to the scanning electrode Y in each display line. From the above, the AC-driven type PDP device 1 can perform sustain discharge.

During the sustain discharge period, wall charges with a different polarity in such an amount as makes the sustain discharge possible are stored on the protective film surface on the common electrode X and the scanning electrode Y. When discharge is carried out between the common electrode X and the scanning electrode Y, the wall charges on the common electrode X and the scanning electrode Y in the cell become the wall charges with the reverse polarity from the polarity the wall charges had so far, and converge the discharge. At this time, a time is required for the wall charges to move, and the time is determined by the time during which the voltage +Vs/2 or the voltage −Vs/2 is applied to the common electrode X.

As a specific example of the circuit shown in FIG. 16, a circuit in FIG. 17 can be conceived. FIG. 17 shows a circuit diagram in which a power MOSFET (or IGBT may be used) is used as each of the switch elements SW1 to SW5 in the circuit shown in FIG. 16. In FIG. 17, drive circuits which drive the respective switch elements SW1 to SW5 are also shown. In FIG. 17, drive circuits M1, M2, M3N and M3P are constituted by using drive circuits MA. The drive circuit MA is constituted by using a waveform processing circuit 802, a high level shift circuit 803 and an output amplifying circuit 804.

A signal IN1 that is inputted from an input signal terminal is converted into a signal with the voltage of an output reference voltage terminal Vss as a reference, via the high level shift circuit 803. The output voltage of the high level shift circuit 803 is amplified via the output amplifying circuit 804, and is supplied to the switch element SW1 as drive pulse for the switch element SW1. Power supply voltage of the output amplifying circuit 804 is supplied to an output power supply terminal Vc of the drive circuit M1 via a diode DE from a power supply voltage Ve. In the period in which the first signal line OUTA has the ground voltage (the period in which the switch element SW2 is ON, t6 to t10 in FIG. 18), the above-described diode DE is turned ON, and the charges are charged in a capacitor CE. The charges are supplied as the drive pulse to a control terminal of the switch element SW1 via the above-described output amplifying circuit 804 in the period from t1 to t6 (the same timing of the next cycle) in FIG. 18.

In FIG. 17, drive circuits M4, M5, M6 and M7 are constituted by using drive circuits MB. The drive circuit MB is constituted by using a gate coupler that is an optical transmitting element. The gate coupler is an element in which both a photo coupler and an amplifying circuit are contained in one package, and is capable of directly driving gate terminals of a power MOSFET, IGBT and the like. Instead of the gate coupler, the combination of a photo coupler and an amplifying circuit may be used.

By works of the above-described gate-couplers M4 to M7, the switches SW4 to SW7 can be driven based on input signals IN4 to IN7 which are inputted from the input terminals with the ground voltage as the reference. In the above-described drive circuit MB, an input part and an output part are separated by light, and therefore stable drive can be performed even if the reference voltages of the input part and the output part differ. The driving method of the TERES circuit using an optical transmitting element is described in the following Patent Document 2.

[Patent Document 1] EP Patent Application Publication No. 1065650 (Japanese Patent No. 3201603)

[Patent Document 2] US Patent Application Publication No. 2002-0097203 (Japanese Patent Application Laid-open No. 2002-215087)

SUMMARY OF THE INVENTION

An object of the present invention is to provide a drive circuit and a plasma display device with a small circuit scale and high reliability.

According to one aspect of the present invention, there is provided a drive circuit for a matrix type display device for applying a predetermined voltage to a capacitive load being a display, comprising a first signal line for supplying a potential to one terminal of the capacitive load, a first switch element for supplying a first potential to the aforesaid first signal line, a first drive circuit for driving the aforesaid first switch element, a second switch element for supplying a third potential to the aforesaid first signal line, a second signal line for supplying a second potential different from the first potential to the one terminal of the capacitive load, a first capacitor connected between the aforesaid first signal line and the aforesaid second signal line and capable of supplying a lower potential than the first and the third potentials to the aforesaid first signal line, a third switch element for supplying the third potential to the aforesaid second signal line, a fourth switch element for connecting the aforesaid first signal line to the one terminal of the capacitive load, a fifth switch element for connecting the aforesaid second signal line to the one terminal of the capacitive load, a coil circuit connected between at least one of the aforesaid first signal line and the aforesaid second signal line, and a supply line for supplying the third potential, and a floating power supply circuit for supplying a power supply voltage with the potential of the aforesaid first signal line as a reference to the aforesaid first drive circuit.

According to another aspect of the present invention, there is provided a drive circuit for a matrix type display device for applying a predetermined voltage to a capacitive load being a display comprising a first signal line for supplying a potential to one terminal of the capacitive load, a first switch element for supplying a first potential to the aforesaid first signal line, a first drive circuit for driving the aforesaid first switch element, a second switch element for supplying a third potential to the aforesaid first signal line, a second signal line for supplying a second potential different from the first potential to the one terminal of the capacitive load, a first capacitor connected between the aforesaid first signal line and the aforesaid second signal line and capable of supplying a lower potential than the first and the third potentials to the aforesaid first signal line, a third switch element for supplying the third potential to the aforesaid second signal line, a fourth switch element for connecting the aforesaid first signal line to the one terminal of the capacitive load, a fifth switch element for connecting the aforesaid second signal line to the one terminal of the capacitive load, a coil circuit connected between at least one of the aforesaid first signal line and the aforesaid second signal line, and a supply line for supplying the third potential, and a drive starting switch circuit connected in parallel with the aforesaid first switch element, and brought into conduction when a power supply is turned on to charge the aforesaid first capacitor.

DETAILED DESCRIPTION OF THE PREFERRED EMBODIMENTS

Embodiments of the present invention will be explained by using the drawings hereinafter.

Figure 1:
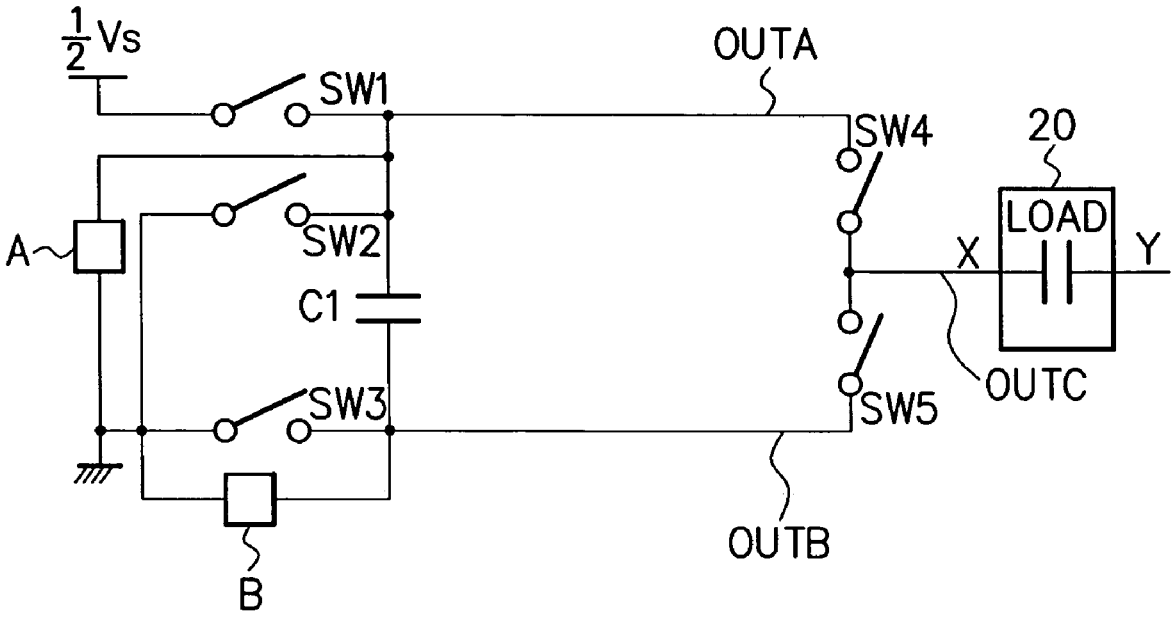
FIG. 1 is a diagram showing a schematic constitution example of a drive circuit of an AC-driven type PDP device.
Figure 2:
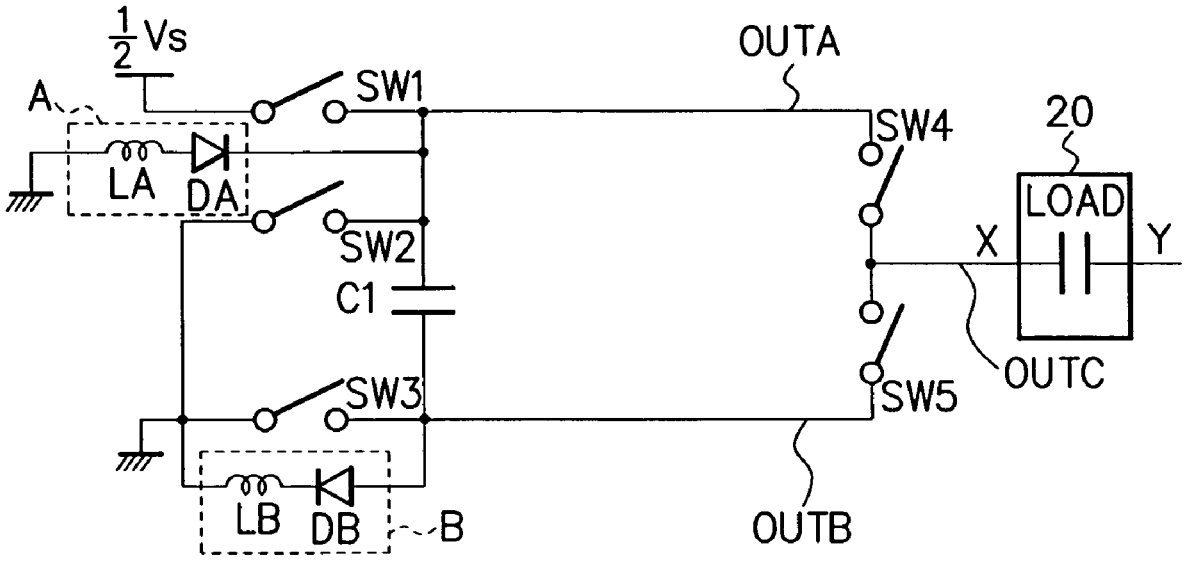
FIG. 2 is a diagram showing a schematic constitution of a drive circuit in which coil circuits A and B shown in FIG. 1 are replaced with concrete circuits.
Figure 3:
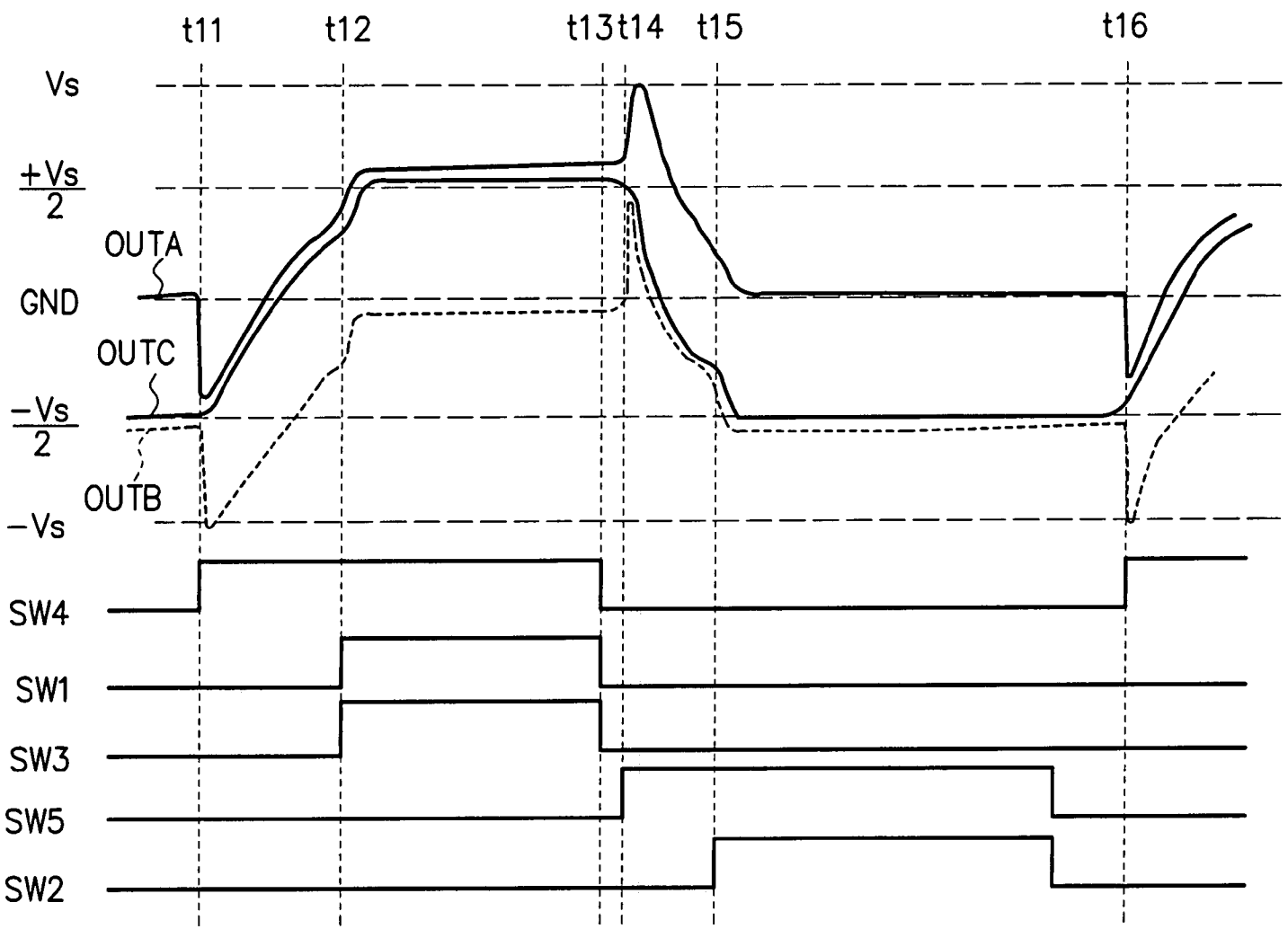
FIG. 3 is a waveform diagram showing an operation of the drive circuit shown in FIG. 2.
Figure 4:
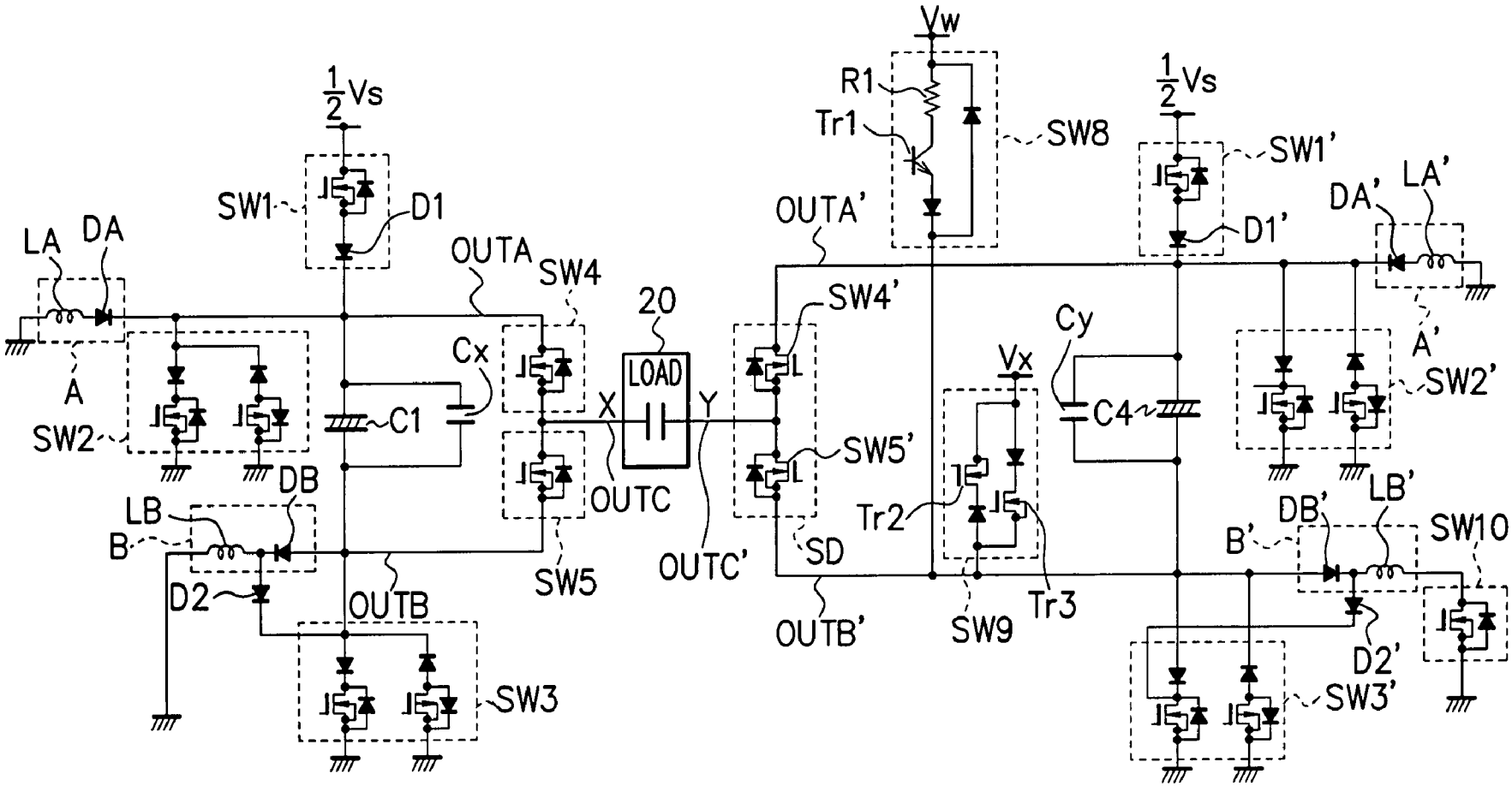
FIG. 4 is a diagram showing a plasma display device to which the drive circuit shown in FIG. 2 is applied.
Figure 13:
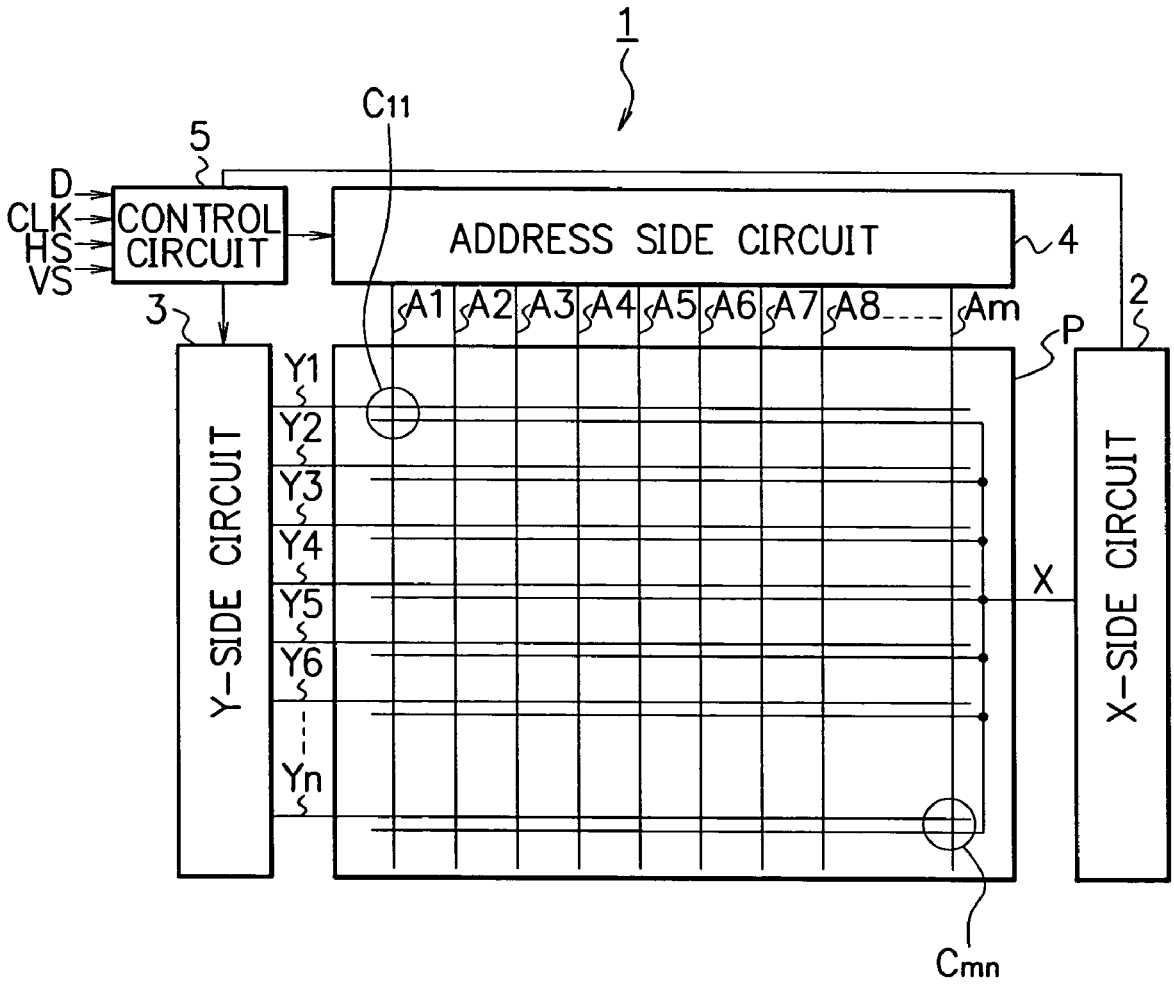
FIG. 13 is a block diagram of an entire plasma display device.
Figure 14A:
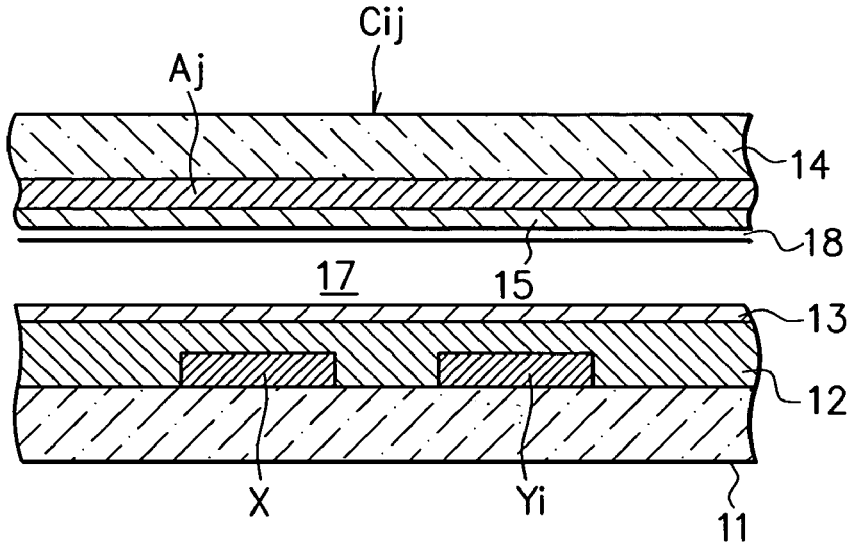
FIGS. 14A, 14B and 14C are diagrams showing an example of a plasma display panel.
Figure 14B:
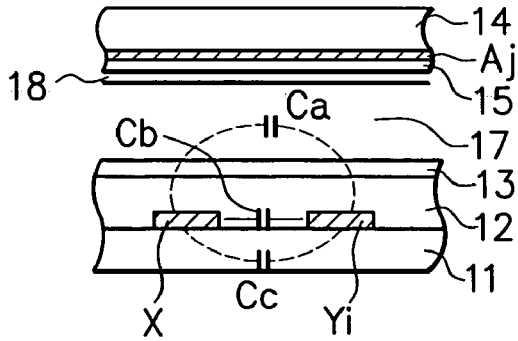
Figure 14C:
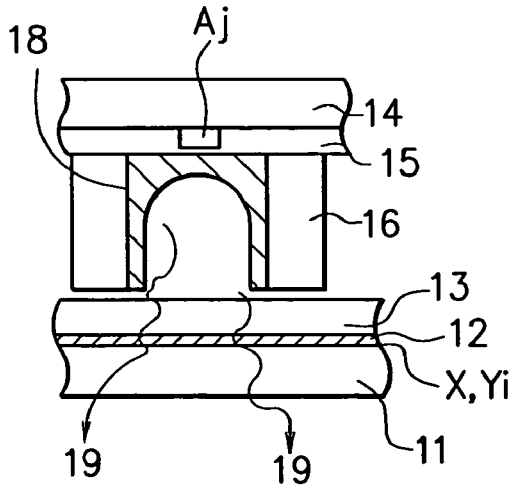
Figure 15:
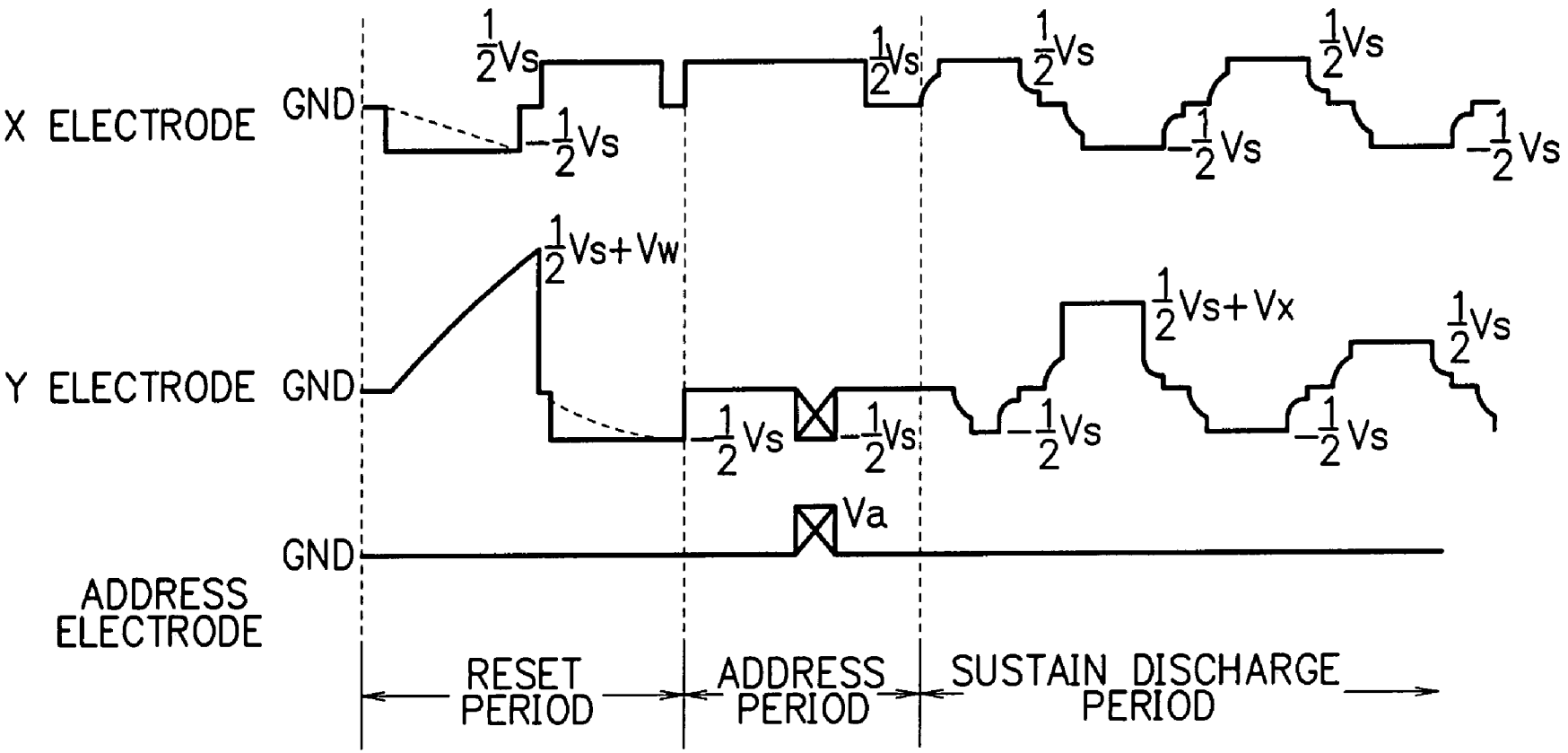
FIG. 15 is a diagram showing driving waveforms of the plasma display device.

The embodiments of the present invention use a plasma display device (matrix type plane display device) shown in FIG. 13 to FIG. 15. FIG. 13 to FIG. 15 and the explanation thereof are the same as described above. In order to further reduce the circuit elements with respect to the above-described TERES circuit, Japanese Patent Application No. 2002-290535 is filed by the same applicant as the present application (not published yet). FIG. 1 shows a principle diagram of a circuit described in Japanese Patent Application No. 2002-290535. FIG. 2 is a diagram showing a circuit example of the principle diagram shown in FIG. 1. FIG. 3 shows an operation waveform diagram in FIG. 2. FIG. 4 shows an example in which the circuit shown in the above-described FIG. 2 is applied to an X electrode driving circuit and a Y electrode driving circuit of the plasma display device.

FIG. 1 is a diagram showing a schematic constitution example of a drive circuit for an AC-driven type PDP (plasma display panel) device according to the embodiments of the present invention. The drive circuit in the embodiments shown in FIG. 1 can be applied to an AC-driven type PDP device (display device) 1 of which entire constitution is shown in FIG. 13, and of which cell constitution is shown in FIG. 14, for example. The drive circuit can also handle with the operations in the reset period and the address period shown in FIG. 15. The drive circuit can also correspond to the adding operation of the initial voltage Vx in the scanning electrode Y in the sustain discharge period shown in FIG. 15. In FIG. 1, those given the same reference numerals and symbols as the reference numerals and symbols in FIG. 16 have the same functions. In FIG. 1, only the schematic constitution of the X-side circuit is shown as in FIG. 16, and the constitutions of the Y-side circuit is omitted because they have the same constitution and operation as the X-side circuit. Detailed circuit examples of both of the X-side circuit and Y-side circuit will be described later.

In FIG. 1, a capacitive load 20 (hereinafter, called "load") is the total capacitance of a cell formed between one common electrode X and one scanning electrode Y. The common electrode X and the scanning electrode Y are formed in the load 20. Here, the scanning electrode Y means an arbitrary scanning electrode in a plurality of scanning electrodes Y1 to Yn.

First, switches SW1 and SW2 are connected in series between a power supply line (first power supply line) for voltage (Vs/2) that is supplied from a power supply and the ground. One terminal of a capacitor C1 is connected to an interconnection point of the above-described two switches SW1 and SW2, and a switch SW3 is connected between the other terminal of the capacitor C1 and the ground. A signal line which is connected to the one terminal of the capacitor C1 is set as a first signal line OUTA, and a signal line which is connected to the other terminal is set as a second signal line OUTB.

Further, a coil circuit A is connected between the interconnection point of the above-described two switches SW1 and SW2, and the ground. Both terminals of a coil circuit B are connected in parallel to both terminals of the switch SW3. In other words, the coil circuit A is connected between the first signal line OUTA and the ground, and the coil circuit B is connected between the second signal line OUTB and the ground. The coil circuits A and B are the circuits including at least coils, and the coils are constituted to cause the L-C resonance with the load 20 via switches SW4 and SW5. Namely, the coil circuits A and B and the load 20 constitute a power recovering circuit.

The switch SW4 and the switch SW5 which are connected in series are connected to both terminals of the above-described capacitor C1. An interconnection point of these two switches SW4 and SW5 is connected to the common electrode X of the load 20 via an output line OUTC. Though not shown, the similar circuits are also connected to the scanning electrode Y side of the load 20.

The aforementioned switches SW1 to SW5 are controlled by control signals respectively supplied from a drive control circuit 5 shown in FIG. 13, for example. As described above, the drive control circuit 5 is constituted by using a logic circuit and the like, generates the above-described control signals based on display data D supplied from an outside, a clock CLK, a horizontal synch signal HS, a vertical synch signal VS and the like, and supplies the control signals to the switches SW1 to SW5. According to the above constitution, the drive circuit in FIG. 1 performs sustain discharge in a sustain discharge period that is the period in which the common electrode X and the scanning electrode Y in the cell carry out the discharge.

Here, by replacing the aforementioned coil circuits A and B with concrete circuits, an operation of the aforementioned drive circuit will be explained.

FIG. 2 is a schematic constitution of the drive circuit in which the coil circuits A and B shown in FIG. 1 are replaced with the concrete circuits. As shown in FIG. 2, the coil circuit A includes a diode DA and a coil LA, and the coil circuit B includes a diode DB and a coil LB. A cathode terminal of the diode DA is connected to the interconnection point of the switches SW1 and SW2. In other expressions, the cathode terminal of the diode DA is connected to the first signal line OUTA. An anode terminal of the diode DA is connected to the ground via the coil LA. A cathode terminal of the diode DB is connected to the ground via the coil LB. An anode terminal of the diode DB is connected to an interconnection point of the capacitor C1 and the switch SW3. In other expressions, the anode terminal of the diode DB is connected to the second signal line OUTB.

As the forward direction of the aforementioned diode DA shows, the coil circuit A is a charging circuit for supplying charges to the load 20 via the switch SW4. As the forward direction of the diode DB shows, the coil circuit B is a discharge circuit for discharging charges to the load 20 via the switch SW5. Power recovering processing for the load 20 is realized by controlling the timing of the charging processing of the charging circuit constituted of the coil circuit A, the switch SW4 and the load 20, and the discharging processing of the discharge circuit constituted of the coil circuit B, the switch SW5 and the load 20. In FIG. 2, the other constitutions of the coil circuits A and B are the same as the constitutions shown in FIG. 1, and the explanation will be omitted.

Next, an operation of the drive circuit shown in FIG. 2 will be explained.

FIG. 3 is a waveform diagram showing the operation of the drive circuit shown in FIG. 2. In FIG. 3, the voltage waveforms of the first signal line OUTA, the second signal line OUTB and the output line OUTC are displayed together. Here, the vertical axis of the voltage waveforms corresponds to the voltage value of the output line OUTC. The voltage waveform of the first signal line OUTA is raised a little while the voltage waveform of the second signal line OUTB is lowered a little so that they do not to overlap the voltage waveform of the output line OUTC for convenient reference.

When the switch SW4 is turned ON first in the state in which the first signal line OUTA is at the ground, the second signal line OUTB and the output line OUTC are at −Vs/2, and the switches SW1 to SW5 are OFF, the voltage −Vs/2 stored in the load 20 is transmitted to the first signal line OUTA via the switch SW4, the voltage of the first signal line OUTA becomes −Vs/2, and the voltage is applied to the one terminal of the capacitor C1. As a result, the potential at the other terminal of the capacitor C1 changes to −Vs, and the voltage of the second signal line OUTB also becomes −Vs (t11).

Immediately after the time t11, the L-C resonance occurs between the coil LA and the capacitance of the load 20 via the switch SW4, and thereby the charges are supplied to the load 20 from the ground via the coil LA and the switch SW4. Therefore, the potentials of the first signal line OUTA and the output line OUTC rise from −Vs/2 to around +Vs/2 via the potential of the ground level. By such a flow of current, the voltage of the output line OUTC which is applied to the common electrode X gradually rises as shown in the times t11 to t12 in FIG. 3.

Next, the switches SW1 and SW3 are turned ON in the vicinity of the peak voltage which occurs at the time of the resonance, whereby the voltage of the output line OUTC, which is applied to the common electrode. X, is clamped to Vs/2 (t12). Next, the switches SW1, SW3 and SW4 are turned OFF (t13). Next, the switch SW5 is turned ON (t14). As a result, the voltage Vs/2 stored in the load 20 is applied to the second signal line OUTB via the switch SW5, and the voltage of the second signal line OUTB becomes Vs/2. As a result, the voltage of the first signal line OUTA rises to Vs.

Immediately after the time t14, the L-C resonance occurs between the coil LB and the capacitance of the load 20 via the switch SW5, and thereby the load 20 discharges the charges to the ground via the coil LB and switch SW5. Therefore, the potentials of the second signal line OUTB and the output line OUTC lower from +Vs/2 to around −Vs/2 via the potential of the ground level. By such a flow of the current, the voltage of the output line OUTC which is applied to the common electrode X gradually lowers as shown in the times t14 to t15 in FIG. 3.

Next, the switch SW2 is turned ON in the vicinity of the peak voltage which occurs at the time of this resonance, and thereby the voltage of the output line OUTC, which is applied to the common electrode X, is clamped to −Vs/2 (t15). From the operation described above, the drive circuit shown in FIG. 2 applies voltage which changes from −Vs/2 to Vs/2 to the common electrode X during the sustain discharge period. The voltage (+Vs/2, −Vs/2) with a different polarity from the voltage applied to the aforementioned common electrode X is alternately applied to the scanning electrode Y in each display line. From the above, the AC-driven type PDP device can perform sustain discharge.

Figure 18:
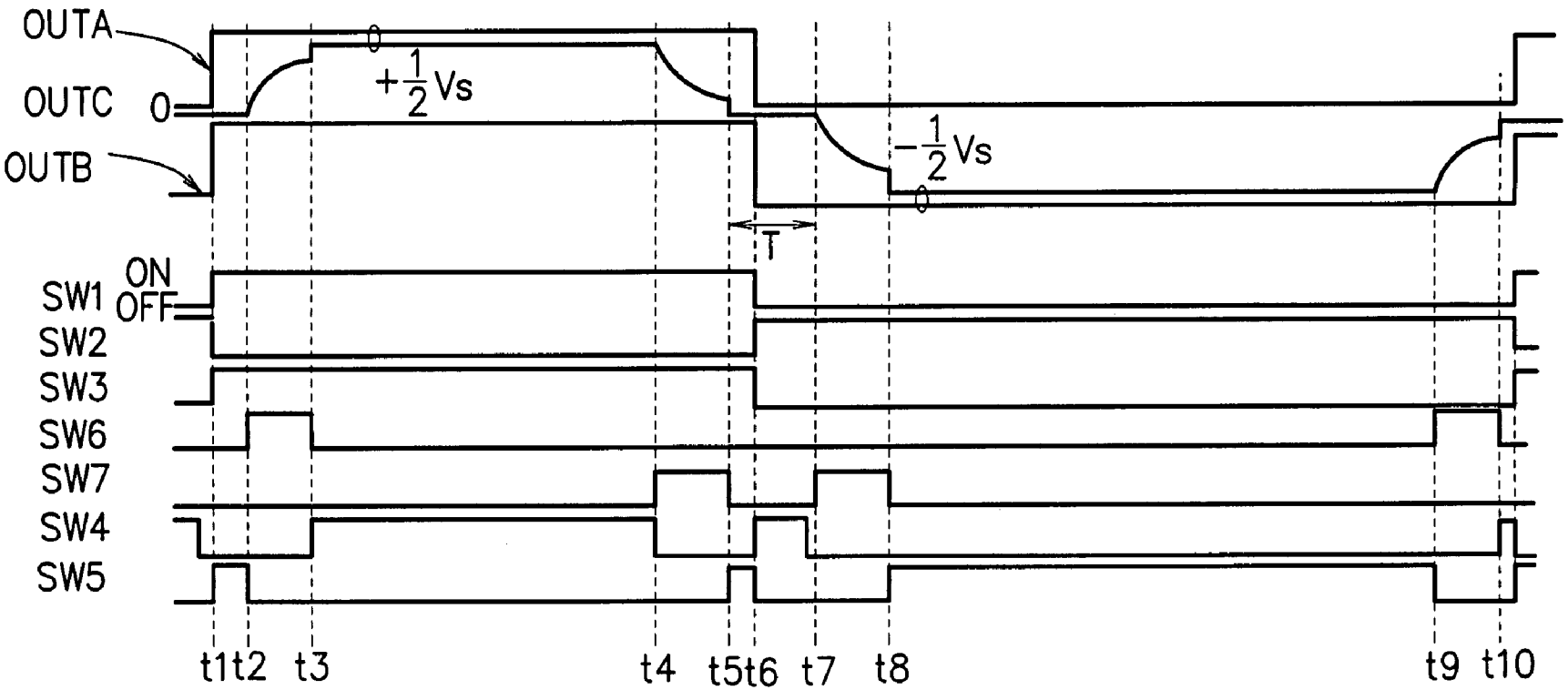
FIG. 18 is an operation waveform diagram of the circuit shown in FIG. 16.

As shown in FIG. 3, when compared with FIG. 18 which is the waveform diagram of the conventional art, the period T of the ground level which is shown in FIG. 18 does not exist in the voltage waveform of the output line OUTC in FIG. 3. Namely, the drive circuit of this embodiment can increase the time in which the voltage Vs/2 or the voltage −Vs/2 which is a top width or a bottom width of the sustain discharge pulse is sustained as compared with the conventional art when the sustain operation is performed with the same cycle. In the sustain discharge period, the time for the wall charges to move is necessary as described above, and the time for this can be reliably ensured as a result. Further, the same sustain time as in the conventional art is ensured, and the sustain discharge can be performed more stably in the drive circuit of this embodiment, and expansion of the operation margin, enhancement of the luminance of the panel P, and the like can be also expected.

Figure 16:
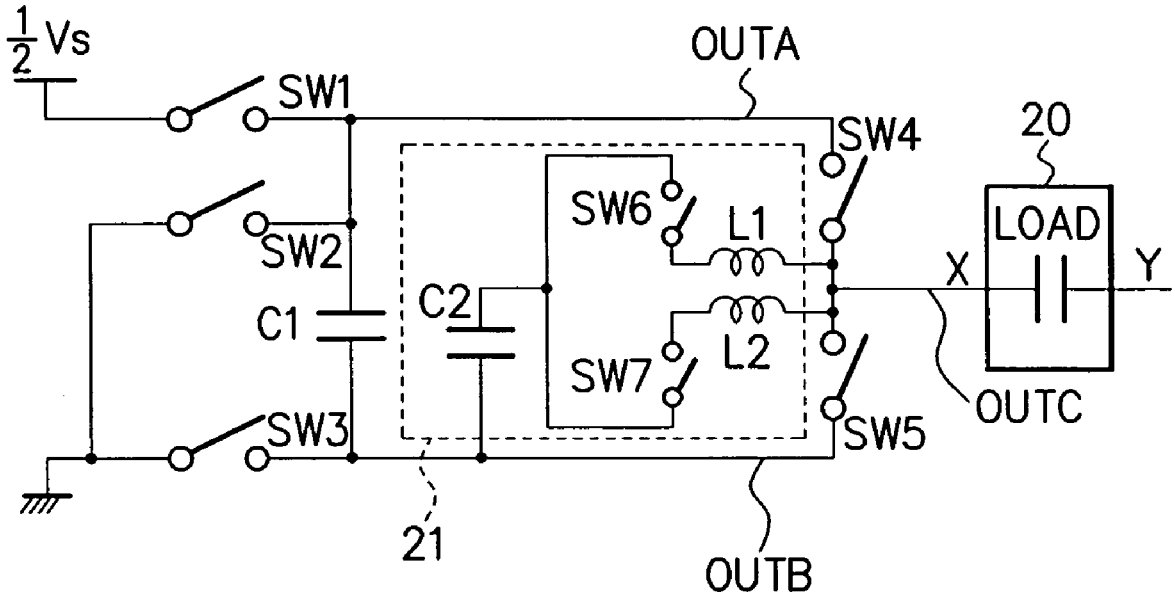
FIG. 16 is a principle diagram of a TERES type drive circuit.

Further, comparing the circuit constitution of the conventional drive circuit shown in FIG. 16 and the circuit constitution of the drive circuit of this embodiment shown in FIG. 2, the number of switches is decreased as the switches SW6 and SW7 in FIG. 16 do not exist in FIG. 2. Thus, complication of the switch control is reduced. Further, it is not necessary to interpose the circuit for performing level shift for the control signals for controlling the switches SW6 and SW7 in FIG. 16, or to electrically separate the transmission path by using a photo coupler or the like in the transmission path of the control signals between the control signal circuit and the switches SW6 and SW7, and therefore the number of components can be reduced. In the drive circuit in FIG. 2, the capacitor C2 included in the drive circuit in FIG. 16 can be also deleted. Thus, the circuit not shown in FIG. 16 which monitors the voltage applied to the capacitor C2 is not necessary, because the capacitor 2 does not exist. As a result, the number of components can be further reduced.

Next, a concrete circuit example (including the scanning electrode Y side) of the drive circuit shown in FIG. 2 will be explained by showing the drawing.

FIG. 4 is a diagram showing a concrete circuit example of the drive circuit shown in FIG. 2. In FIG. 4, the load 20 is the total capacitance of the cell formed between one common electrode X and one scanning electrode Y. In the load 20, the common electrode X and the scanning electrode Y are formed. Here, the scanning electrode Y means an arbitrary scanning electrode in the scanning electrodes Y1 to Yn shown in FIG. 13.

First, in the common electrode X side, the switches SW1 and SW2 are connected in series between the power supply line for the voltage (Vs/2) that is supplied from a power supply not shown and the ground. One terminal of a capacitor C1 is connected to the interconnection point of the above-described two switches SW1 and SW2, and the switch SW3 is connected between the other terminal of the capacitor C1 and the ground. A capacitor Cx is connected in parallel to the capacitor C1.

The switches SW4 and SW5 which are connected in series are connected to the both terminals of the above-described capacitor C1. The interconnection point of these two switches SW4 and SW5 is connected to the common electrode X of the load 20 via the output line OUTC.

As in FIG. 2, the coil circuit A includes the diode DA and the coil LA, and the coil circuit B includes the diode DB and the coil LB. The cathode terminal of the diode DA is connected to the interconnection point of the switches SW1 and SW2. The anode terminal of the diode DA is connected to the ground via the coil LA. The cathode terminal of the diode DB is connected to the ground via the coil LB and a switch SW10.

The switch SW10 is the switch for preventing the voltages (Vs/2+Vw) and (Vs/2+Vx) which are applied to the second signal line OUTB from directly escaping to the ground in the aforesaid reset period and the address period. The anode terminal of the diode DB is connected to the interconnection point of the capacitor C1 and the switch SW3. The anode terminal of a diode D2 is connected to the cathode terminal of the diode DB. The cathode terminal of the diode D2 is connected to the anode terminal of the diode DB. The cathode terminal of the diode DB is connected to the ground via the coil LB.

In the scanning electrode Y side, switches SW1' and SW2' are connected in series between a power supply line for the voltage (Vs/2) that is supplied from a power supply not shown and the ground. One terminal of a capacitor C4 is connected to an interconnection point of these two switches SW1' and SW2', and a switch SW3' is connected between the other terminal of the capacitor C4 and the ground. A capacitor Cy is connected in parallel with the capacitor C4.

Switches SW4' and SW5' which are connected in series are connected to the both terminals of the above-described capacitor C4. An interconnection point of these two switches SW4' and SW5' is connected to the scanning electrode Y of the load 20 via an output line OUTC'. The switches SW4' and SW5' constitute a scan driver SD. The scan driver SD outputs scan pulses at a scanning time during the address period (see FIG. 15) and performs a selecting operation of the scanning electrode Y for each line. A connecting line for connecting the switch SW4' and the one terminal of the capacitor C4 is set as a third signal line OUTA', and a connecting line for connecting the switch SW5' and the other terminal of the capacitor C4 is set as a fourth signal line OUTB'.

Further, a switch SW8 including a resistor R1 and an npn transistor Tr1 is connected between the fourth signal line OUTB' and the power supply line for generating a writing voltage Vw (see FIG. 15). A switch SW9 including n-channel MOS field effect transistors (FET) Tr2 and Tr3 is connected between the fourth signal line OUTB' and the power supply line which generates a voltage Vx' (see FIG. 15).

The third signal line OUTA' is connected to the ground via a coil circuit A'. The fourth signal line OUTB' is connected to the ground via a coil circuit A'. The coil circuit A' includes a diode DA' and a coil LA', and the coil circuit B' includes a diode DB' and a coil LB'. A cathode terminal of the diode DA' is connected to an interconnection point of the switches SW1' and SW2'. An anode terminal of the diode DA' is connected to the ground via the coil LA'.

A cathode terminal of the diode DB' is connected to the ground via the coil LB' and a switch SW10. The switch SW10 is a switch for preventing the voltages (Vs/2+Vw) and (Vs/2+Vx) which are applied to the fourth signal line OUTB' from escaping directly to the ground in the aforesaid reset period and the address period. An anode terminal of the diode DB' is connected to an interconnection point of the capacitor C4 and the switch SW3'. An anode terminal of a diode D2' is connected to a cathode terminal of the diode DB'. A cathode terminal of the diode D2' is connected to the anode terminal of the diode DB'.

The aforementioned switches SW1 to SW5, SW8 to SW10, SW1' to SW5' and transistors Tr1 to Tr3 are controlled by the control signals supplied respectively from the drive control circuit 5 shown in FIG. 13.

According to the above constitution, the voltage which changes from −Vs/2 to Vs/2 is applied to the common electrode X during the sustain discharge period. The voltage (+Vs/2, −Vs/2) with a different polarity from the voltage supplied to the aforesaid common electrode X is alternately applied to the scanning electrode Y in each display line.

Figure 17:
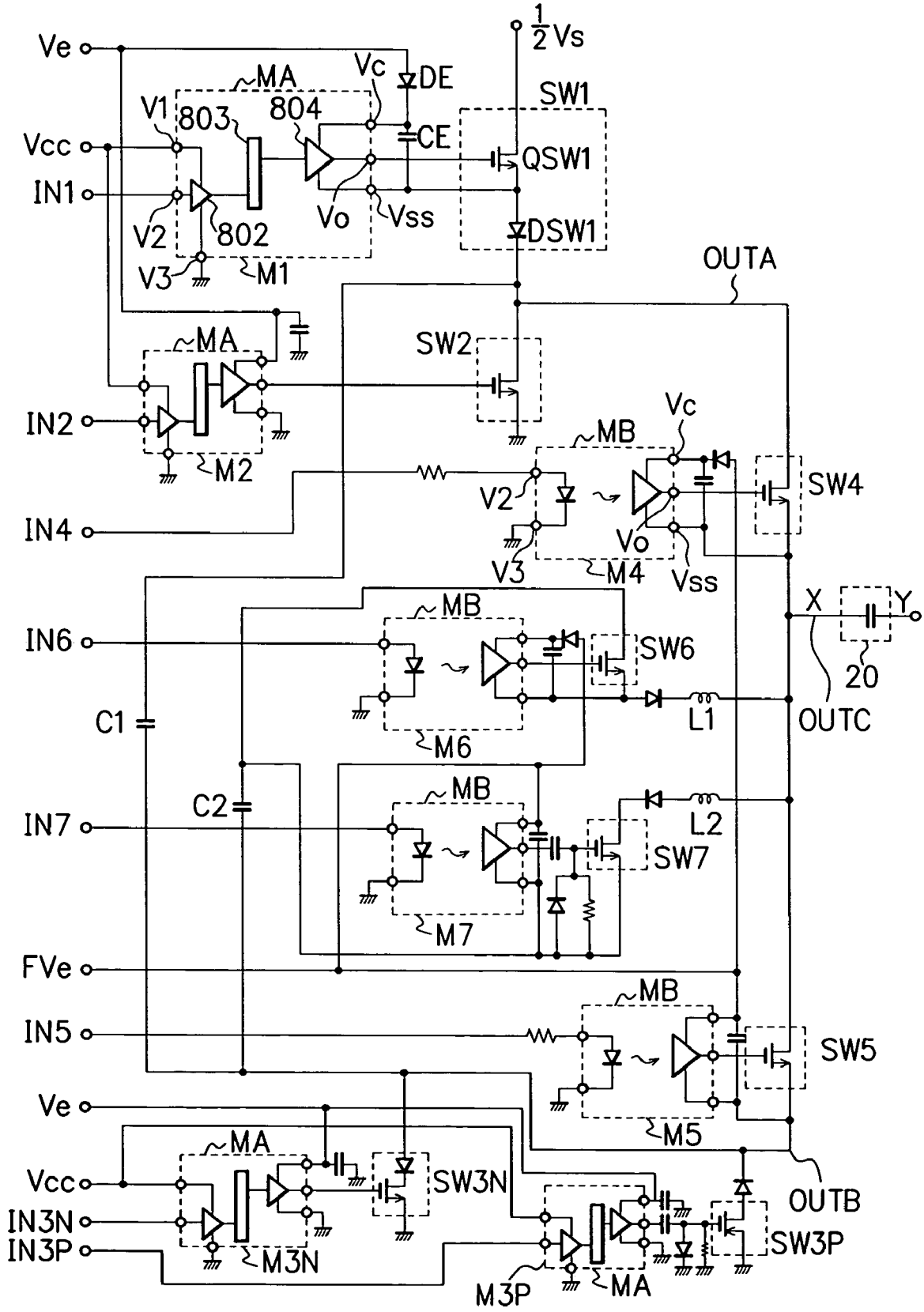
FIG. 17 is a diagram showing an application example of the circuit shown in FIG. 16.

In the circuit shown in FIG. 17, the drive pulse which is supplied to the transistor QSW1 (constituted by power MOSFET, IGBT and the like) constituting the switch SW1 is formed by the drive circuit M1. The drive circuit M1 in FIG. 17 uses the drive circuit MA constituted by the waveform processing circuit 802, the high level shift circuit 803, and the output amplifying circuit 804. The drive circuit MA contains the high level shift circuit 803 which performs level shift of the signal with the ground voltage as the reference to higher voltage than the ground voltage. Thus, when the output terminal (for example, the source terminal of the power MOSFET) of the transistor QSW1, which corresponds to the output reference voltage, is higher than the ground voltage, a normal operation can be performed.

On the other hand, in the circuit shown in FIG. 4, a negative voltage which is lower than the ground voltage is generated in the first signal line OUTA (the period from t11 to t12 in FIG. 3). Thus, the output reference voltage (the voltage generated at the output terminal of the transistor QSW1 (the source terminal in the power MOSFET, the emitter terminal in the IGBT) of the drive circuit M1 (drive circuit MA) shown in FIG. 17 also becomes negative voltage. The high level shift circuit 803 of the drive circuit MA only has the function of performing level shift for the inputted signal to the high voltage side, and therefore when the output reference voltage terminal Vss is at negative voltage, there is the possibility that the signal cannot be transmitted normally. When the above-described drive circuit MA is formed by a PN junction type IC, the substrate is set at the ground voltage. When the above-described output reference voltage terminal Vss becomes negative voltage, the voltage lower than the voltage (ground voltage) applied to the above-described substrate occurs in the IC, and therefore there is the possibility that the IC is broken because an abnormal current flows into the parasitic diode in the IC, and the like.

The switch SW1 shown in FIG. 4 needs to be kept in conduction while the capacitor C1 is charged when the power supply is turned on. The time required for the capacitor C1 to be charged is longer than the sustaining time. Namely, when the capacitor C1 is not charged at the time of start of the sustain discharge period in FIG. 15, a large amount of current flows into the capacitor C1 via the transistor QSW1 (FIG. 17) at the time of the start of the sustain discharge period. Therefore, it is necessary to make the current capacity of the transistor QSW1 large, or there is the possibility that the transistor QSW1 is broken. Therefore, it is necessary to supply the voltage Vs/2 to the capacitor C1 via the switch SW1 when the power supply is turned on to charge the capacitor C1.

The drive circuit M1 for driving the switch SW1 shown in FIG. 4 needs the functions of being capable of normally transmitting signals even when the above-described output reference voltage terminal Vss becomes negative voltage, and capable of supplying drive pulse, which is necessary to charge the capacitor C1 at the time of turning on the power supply, for a long period of time. A drive circuit including the drive circuit having the above-described two functions which are important in putting the method in FIG. 1 to FIG. 4 into practical use will be explained hereinafter.

First Embodiment

Figure 5:
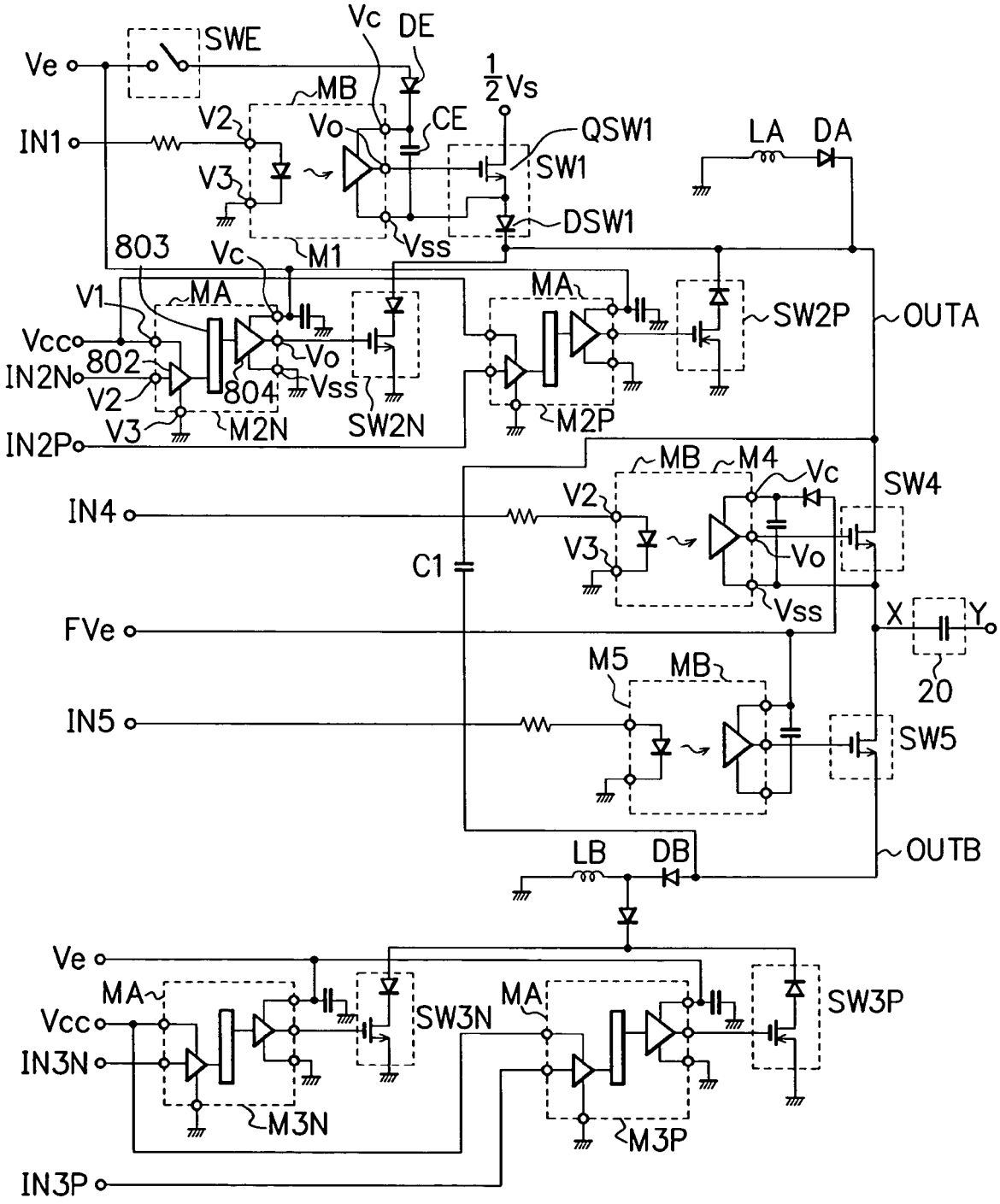
FIG. 5 is a diagram showing a first embodiment of the present invention.

FIG. 5 shows a detailed circuit example of the drive circuit in FIG. 2 according to a first embodiment of the present invention.

Drive circuits M2N, M2P, M3N and M3P are constituted by using the drive circuits MA. The drive circuit MA is constituted by using the waveform processing circuit 802, the high level shift circuit 803 and the output amplifying circuit 804. The waveform processing circuit 802 performs impedance conversion. The high level shift circuit 803 performs level shift for a signal with the ground voltage as a reference to a higher voltage than the ground voltage. The drive circuit MA has an input power supply terminal V1, an input signal terminal V2, an input reference voltage terminal V3, an output power supply terminal Vc, an output signal terminal Vo and an output reference voltage terminal Vss. A voltage Vcc (for example, 5V) is supplied to the input power supply terminal V1. The input reference voltage terminal V3 is connected to the ground. The drive circuit MA converts a signal with the ground reference which is inputted to the input signal terminal V2 into a signal with a potential of the output reference voltage terminal Vss as a reference.

Drive circuits M1, M4 and M5 are constituted by using drive circuits MB. The drive circuit MB has the input signal terminal V2, the input reference voltage terminal V3, the output voltage terminal Vc, the output signal terminal Vo and the output reference voltage terminal Vss, and is constituted by using a gate coupler that is an optical transmitting element. The gate coupler is the element in which both a photo coupler and an amplifying circuit are included in one package, and can directly drive a gate terminal of a power MOSFET, IGBT or the like. In place of the gate coupler, the combination of a photo coupler and an amplifying circuit for amplifying the output voltage of the photo coupler may be used. Since the input part and the output part are separated from each other by light in the drive circuit MB, and therefore even when the reference voltages of the input part and the output part differ, stable driving can be performed, and thus, the same reference voltage conversion as in the drive circuit MA can be performed.

An input signal terminal IN1 is connected to the input signal terminal V2 of the drive circuit M1 via a resistor. The drive circuit M1 is a gate coupler, and has the input signal terminal V2, the input reference voltage terminal V3, the output power supply terminal Vc, the output signal terminal Vo and the output reference voltage terminal Vss. A capacitor CE is connected between the output power supply terminal Vc and the output reference voltage terminal Vss. The terminal of voltage Ve (for example, 15V) is connected to the output power supply terminal Vc via a switch SWE and a diode DE.

The switch SW1 has an n-channel MOSFET QSW1 and a diode DSW1. In the transistor QSW1, the gate is connected to the output signal terminal Vo, the drain is connected to a terminal of the voltage Vs/2 (fro example, 90V), and the source is connected to the output reference voltage terminal Vss and an anode of the diode DSW1. A cathode of the diode DSW1 is connected to the signal line OUTA. The transistor QSW1 operates with the output reference voltage terminal Vss as the reference. This output reference voltage terminal Vss is connected to the signal line OUTA via the diode DSW1, and therefore its potential changes with a lapse of time (see FIG. 3). Therefore, the drive circuit M1 converts a signal of the ground reference of the input signal terminal IN1 into a signal with the potential of the output reference voltage terminal Vss as the reference.

The switch SW2 has switches SW2N and SW2P. The switch SW2N is constituted of an n-channel MOSFET and a diode, and is driven by a drive circuit M2N. The switch SW2P is constituted of a p-channel MOSFET and a diode, and is driven by the drive circuit M2*p*.

The switch SW3 has switches SW3N and SW3P. The switch SW3N is constituted of an n-channel MOSFET and a diode, and is driven by the drive circuit M3N. The switch SW3P is constituted of a p-channel MOSFET and a diode, and is driven by the drive circuit M3P.

The switch SW4 is constituted of an n-channel MOSFET, and is driven by the drive circuit M4. The switch SW5 is constituted of an n-channel MOSFET, and is driven by the drive circuit M5.

As described above, as the drive circuit M1 for driving the transistor QSW1, the drive circuit MB is used. The drive circuit MB is constituted by using a gate coupler which is an optical transmitting element. The gate coupler is an element in which both a photo coupler and an amplifying circuit are contained in one package, and can directly drive the gate terminal of a power MOSFET, IGBT or the like. In place of the gate coupler, the combination of a photo coupler and an amplifying circuit may be used. The drive circuit M1 can transmit a signal normally by using the optical transmitting element even when the signal line OUTA becomes a negative voltage as shown in FIG. 3.

By the operation of the above-described gate coupler, the switch SW1 can be driven based on the signal with the ground potential as the reference, which is inputted from the input signal terminal IN1. In the above-described drive circuit MB, the input part and the output part are separated by light, and therefore stable drive can be performed even when the reference voltages of the input part and the output part are different.

In the circuit shown in FIG. 5, the floating power supply circuit is constituted by using the switch SWE, the diode DE and the capacitor CE. In this floating power supply circuit, the switch SWE is turned ON when the signal line OUTA is at the ground voltage (t13 to t16 in FIG. 3), and charges are stored in the capacitor CE. The switch SWE is always kept OFF except when the signal line OUTA is at the ground voltage. The floating power supply circuit supplies the power supply voltage with the potential of the signal line OUTA (Vss) as the reference to the power supply terminal Vc of the drive circuit M1.

The charges stored in the above-described capacitor CE are supplied as the drive pulse to the gate terminal of the transistor QSW1 in t12 to t13 in FIG. 3. As a result, the transistor QSW1 is turned ON, and the voltage of the signal line OUTA is raised to ½Vs.

When the power supply is turned on, it is necessary to gradually supply the charging current to the capacitor C1 via the transistor QSW1. When the capacitor C1 is not charged when the power supply is turned on, there is the possibility that a large amount of current flows from the power supply voltage ½Vs side via the transistor QSW1 at the same time when the transistor QSW1 is turned ON, and it exceeds the current rate of the transistor QSW1 to break the transistor QSW1. In order to solve this problem, in the time period when the power supply voltage ½Vs rises when the power supply is turned on, the transistor QSW1 is brought into conduction so that charging current gradually flows into the capacitor C1.

In order to charge the above-described capacitor C1 gradually when the power supply is turned on, it is necessary that the drive circuit M1 continues high level of the drive pulse in a comparatively long period of time (as compared with the sustain period) in which the charging current flows into the above-described capacitor C1. Therefore, in the above-described floating power supply circuit, the capacitance of the capacitor CE for the power supply which is supplied to the drive circuit M1 is set at a sufficiently large value, so that the necessary amount of charges to keep the transistor QSW1 in conduction for a long period of time can be stored.

Especially when a high-speed gate coupler suitable for the sustain circuit of the plasma display device is used as the above-described drive circuit M1, it is necessary to increase the bias current which is passed to an optical passive element of the gate coupler, and therefore it is necessary to use a capacitor of a large capacitance for the above-described capacitor CE. As a result of the experiment, it is found out that the capacitor CE needs the capacitance of 100 μF or more.

In the circuit shown in FIG. 5, stable drive pulse can be supplied to the transistor QSW1 by the operation of the floating power supply circuit constituted of the above-describe drive circuit M1, the switch SWE, the diode DE and the capacitor CE even when the signal line OUTA becomes a negative voltage. The capacitor C1 can be gradually charged when the power supply is turned on, and safety of the above-described drive circuit operation can be ensured.

Second Embodiment

Next, a second embodiment of the present invention will be explained by using FIG. 6. In the second embodiment, another floating power supply circuit (DC/DC converter DC1) is used in place of the floating power supply circuit (the switch SWE, the diode DE) in the first embodiment (FIG. 5).

Figure 6:
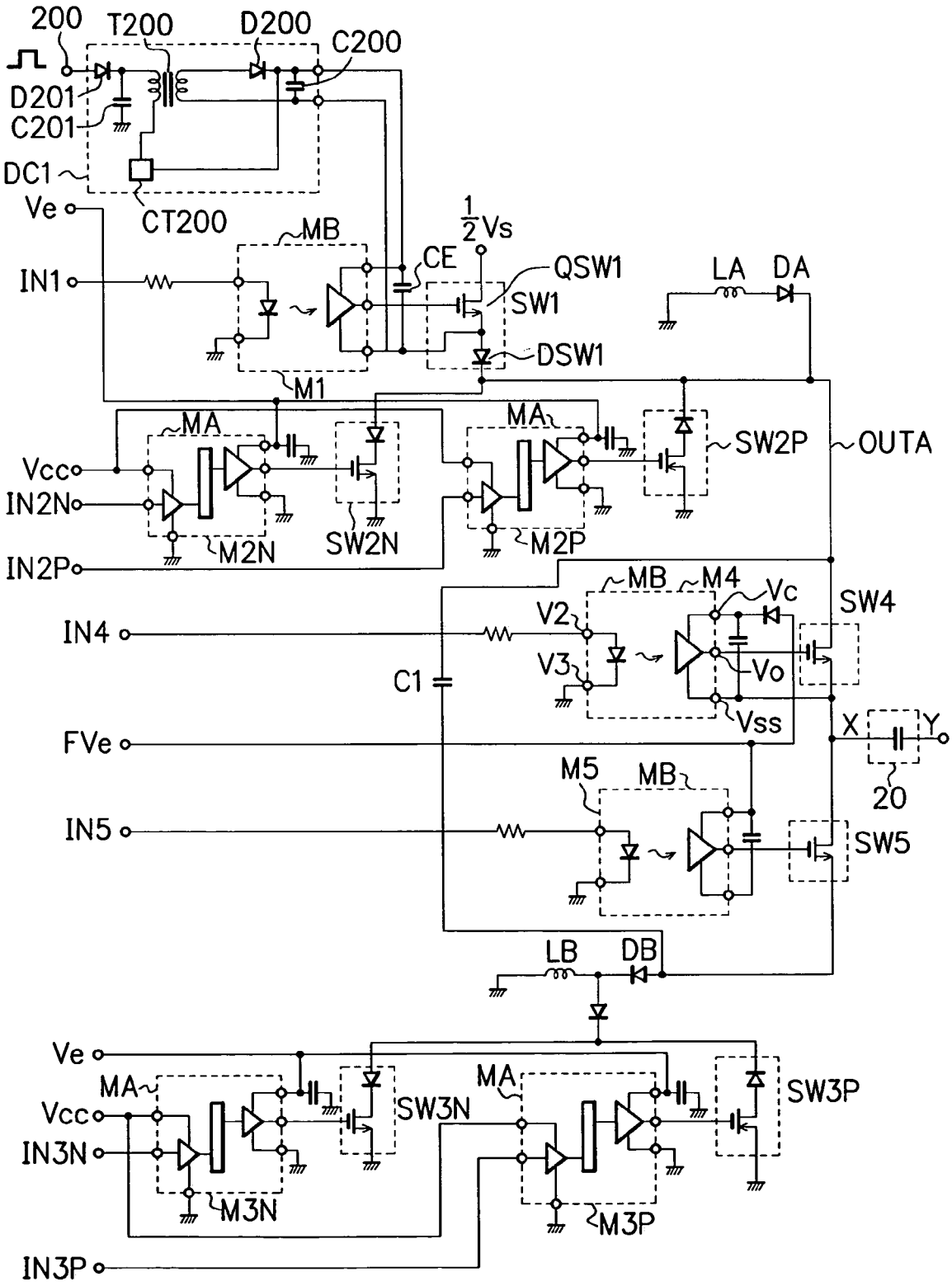
FIG. 6 is a diagram showing a second embodiment of the present invention.

In the circuit shown in FIG. 6, a floating power supply is constituted by using a DC/DC converter DC1 and the capacitor CE. The DC/DC converter DC1 is constituted by using a transformer T200, a control circuit CT200, diodes D200 and D201, and capacitors C200 and C201. In the DC/DC converter DC1, the pulse inputted from an input terminal 200 is rectified by the diode D201 and the capacitor C201, and thereby the input DC voltage is formed. In the above-described DC/DC converter DC1, the output DC voltage is supplied to both the terminals of the capacitor CE, and the reference voltage is the voltage generated at the source terminal (output terminal) of the transistor QSW1. As a result, a stable power supply voltage can be supplied to the drive circuit M1. The same drive circuit MB (constituted of a gate coupler and the like) as in FIG. 5 is used for the drive circuit M1.

In the circuit shown in FIG. 6, the floating power supply voltage which is supplied to the drive circuit M1 can be constituted by the independent circuit which is not influenced by the sustain cycle and the like. Therefore, even when the power supply is turned on or the like, the power supply voltage can be kept stable for a long period (the stable output DC voltage can be always supplied in accordance with the oscillation frequency of the DC/DC converter DC1). Thus, the capacitance value of the capacitor CE connected to the drive circuit M1 can be made small. As in the first embodiment, the drive circuit M1 can transmit a signal normally by using an optical transmitting element, even when the signal line OUTA becomes a negative voltage as shown in FIG. 3.

Third Embodiment

Figure 7:
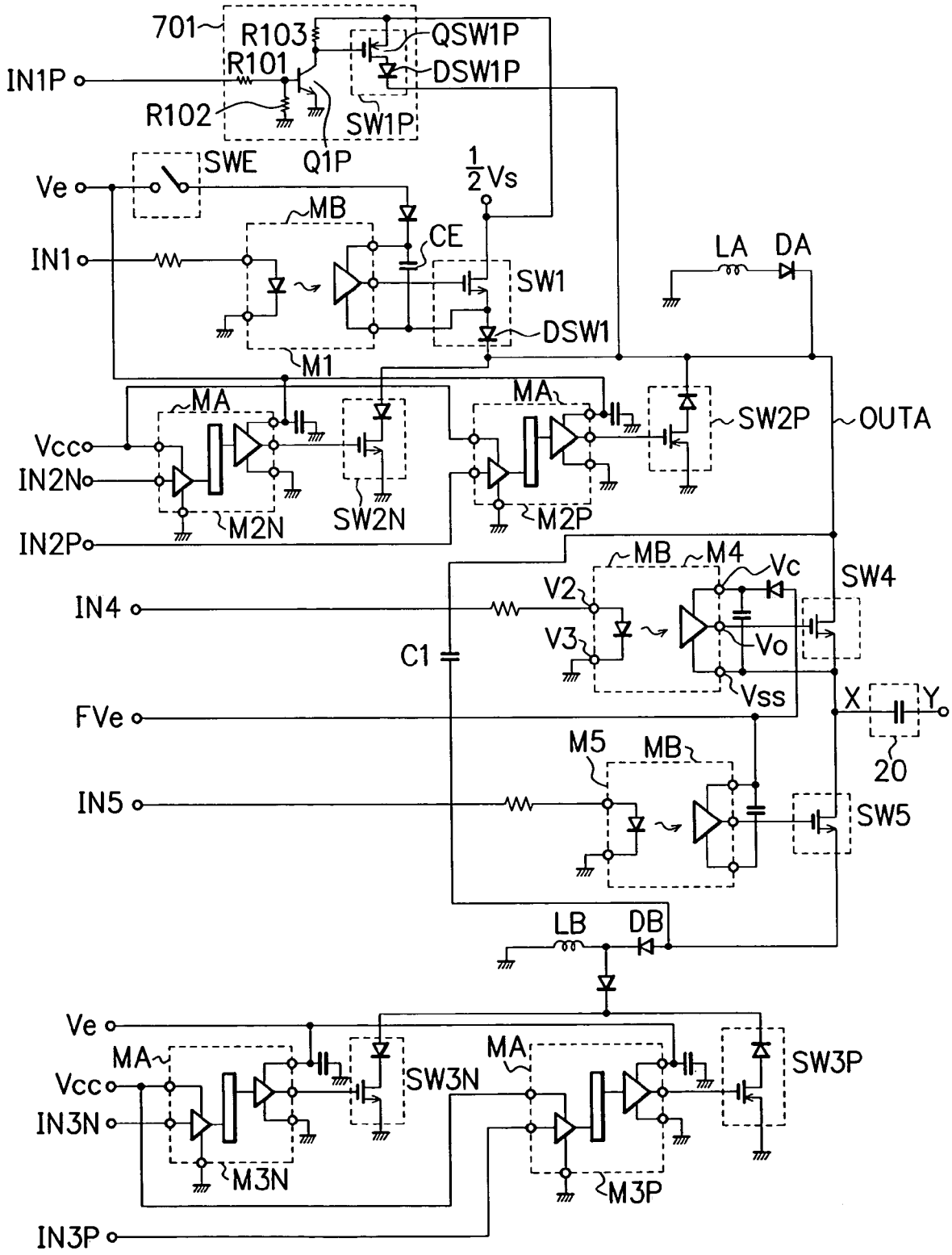
FIG. 7 is a diagram showing a third embodiment of the present invention.

FIG. 7 is a diagram showing a third embodiment of the present invention. In the third embodiment, a drive starting switch circuit 701 is added to the circuit of the first embodiment (FIG. 5). The drive starting switch circuit 701 is constituted of a p-channel power MOSFET QSW1P, an npn bipolar transistor Q1P, a diode DSW1P, resistors R101, R102 and R103.

In the circuit shown in FIG. 7, at the time of turning on the power supply, an input signal IN1P is set at a high level, the transistor Q1P in the drive starting switch circuit 701 is brought into conduction, the transistor QSW1P (constituted by using a p-channel MOSFET) is further brought into conduction, and the capacitor C1 is gradually charged. The drive starting switch circuit 701 is constituted by DC-coupling, and therefore the drive starting switch circuit 701 can keep an ON state for a long time at the voltage level of the input signal IN1P. On this occasion, the switch SW1 is turned OFF. The drive starting switch circuit 701 is connected in parallel with the switch SW1, is in conduction for a time period until the signal line OUTA becomes a predetermined potential from the ground potential at the time of turning on the power supply, and charges the capacitor C1.

On the other hand, in the period in which a large amount of current is passed for a short period such as the sustain period in the plasma display device, the switch SW1 is turned ON, and the drive starting switch circuit 701 is turned OFF. In this manner, the circuit (switch SW1) which needs a large amount of current in a short period such as the sustain period, and the circuit (drive starting switch circuit 701) which is in conduction for a long period of time with a small amount of current are separated, and thereby both of them can be optimally designed.

When the circuit as shown in FIG. 7 is used, it is not necessary to keep the switch SW1 in conduction for a long period of time, and therefore, a capacitor with small capacitance can be used for the capacitor CE constituting the floating power supply circuit.

Fourth Embodiment

Figure 8:
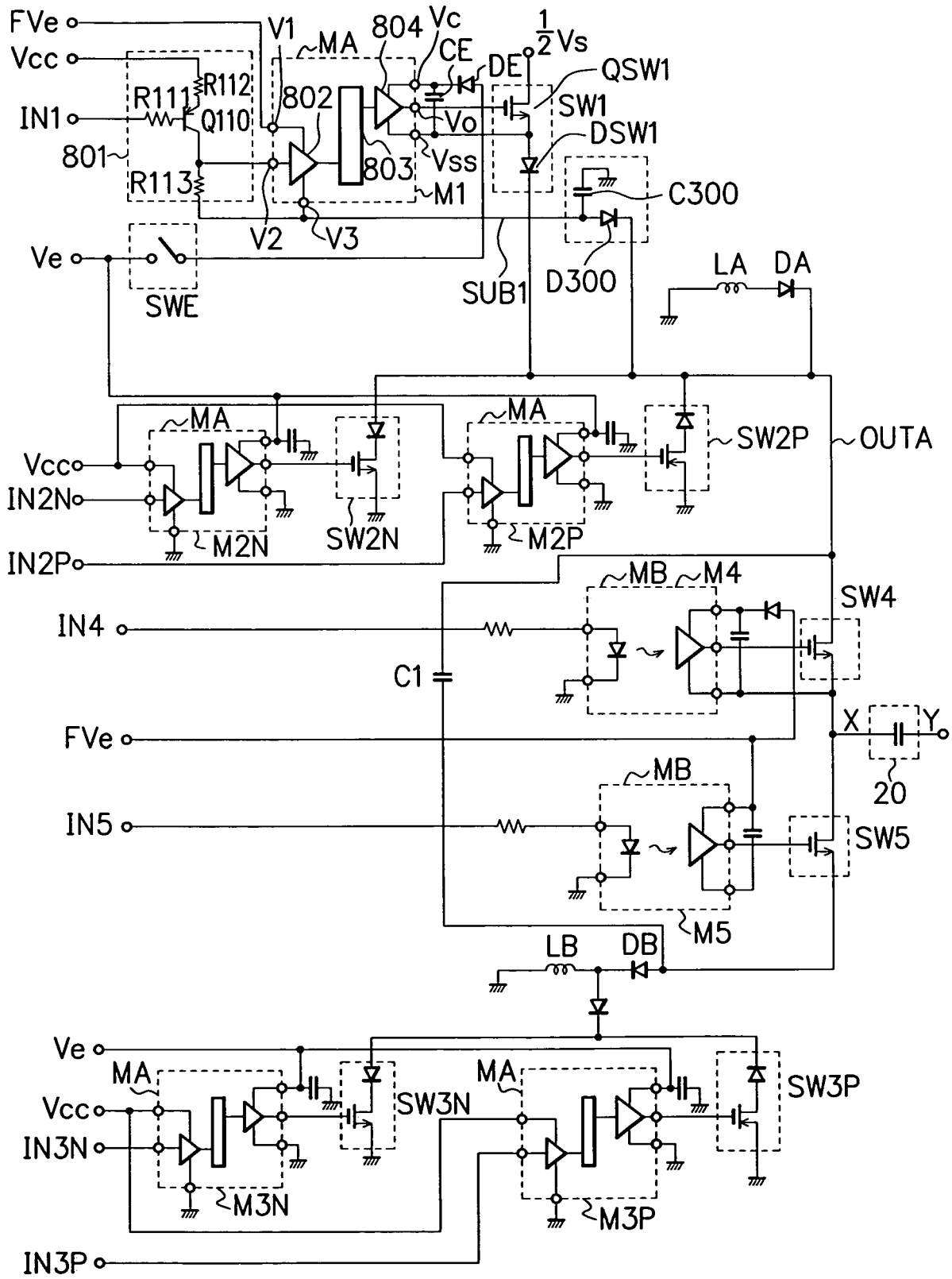
FIG. 8 is a diagram showing a fourth embodiment of the present invention.

FIG. 8 is a diagram showing a fourth embodiment of the present invention. The fourth embodiment is basically the same as the first embodiment (FIG. 5), but only differs from the first embodiment in the point that the drive circuit MA is applied as the drive circuit M1 and a low level shift circuit 801 is added. A floating voltage FVe (for example, 15V) is supplied to the input power supply terminal V1 of the drive circuit M1.

In the circuit shown in FIG. 8, the low level shift circuit 801, the waveform processing circuit 802, the high level shift circuit 803 and the output amplifying circuit 804 are used to form the drive pulse for the transistor QSW1. The low level shift circuit 801 is constituted of a pnp bipolar transistor Q110, and resistors R111, R112 and R113. The waveform processing circuit 802, the high level shift circuit 803 and the output amplifying circuit 804 have the same constitutions as in the drive circuit MA in FIG. 5. In FIG. 8, the floating power supply circuit is constituted by using the switch SWE, the diode DE and the capacitor CE. In FIG. 8, the lowest voltage of the signal line OUTA is rectified by a rectifying circuit constituted of a diode D300 and a capacitor C300, and a voltage SUB1 obtained via the rectifying circuit is supplied to the input reference voltage terminal V3 connected to the waveform processing circuit 802. For example, the voltage SUB1 becomes the voltage in which the lowest voltage (about −Vs/2) of the signal line OUTA in FIG. 3 is held.

The low level shift circuit 801 performs level shift for the reference potential of the input signal IN1 with the ground potential as the reference to the negative side. The high level shift circuit 803 performs level shift of the reference potential of the output signal of the low level shift circuit 801 to a positive side. The output amplifying circuit 804 amplifies the output signal of the high level shift circuit 803.

In the circuit shown in FIG. 8, the signal IN1 with the ground voltage as the reference is converted into a signal with a low level reference voltage SUB1 as the reference via the low level shift circuit 801. The low level reference voltage SUB1 is obtained by rectifying the lowest voltage (for example, negative pulse generated in the period from t11 to t12 in FIG. 13) of the signal line OUTA. Therefore, the low level reference voltage SUB1 is set to be the output reference voltage (source voltage of the transistor QSW1), which is inputted into the reference terminal Vss of the output amplifying circuit 804, or lower. As a result, the signal which is transmitted by the drive circuit MA constituted of the waveform processing circuit 802, the high level shift circuit 803 and the output amplifying circuit 804 has higher voltage than the low level reference voltage SUB1. Accordingly, in the circuit (the circuit which does not use the low level shift circuit) shown in FIG. 17, the problem that the signal cannot be transmitted when the signal line OUTA is at a negative voltage (the period from t11 to t12 in FIG. 3) can be solved. When the above-described embodiment is used, the substrate voltage can be made the lowest voltage (low level reference voltage) which generates inside the IC even when the PN junction type IC is used as the above-described drive circuit MA, and therefore it does not happen that abnormal current flows inside the IC and breaks the IC.

In FIG. 8, a basic operation of the floating power supply circuit which is constituted of the switch SWE, the diode DE and the capacitor CE is the same as the circuit shown in FIG. 5. While in the circuit shown in FIG. 5, the drive circuit MB is used as the drive circuit M1, the drive circuit MA is used as the drive circuit M1 in the embodiment shown in FIG. 8. In order to make the drive circuit MB operate at high speed, it is necessary to pass a large amount of bias current to the optical passive element in the drive circuit MB (gate coupler). On the other hand, the drive circuit MA does not need so much bias current since the drive circuit MA does not use the optical passive element. In the circuit shown in FIG. 5, a capacitor of large capacitance is necessary for the capacitor CE in which the power supply voltage of the drive circuit is stored, because the transistor QSW1 is kept in conduction for a long period of time at the time of turning on the power supply so that the capacitor C1 is gradually charged. On the other hand, in the circuit shown in FIG. 8, an amount of charges consumed in the drive circuit MA is small, and therefore the capacitance of the capacitor CE can be made small.

Figure 11:
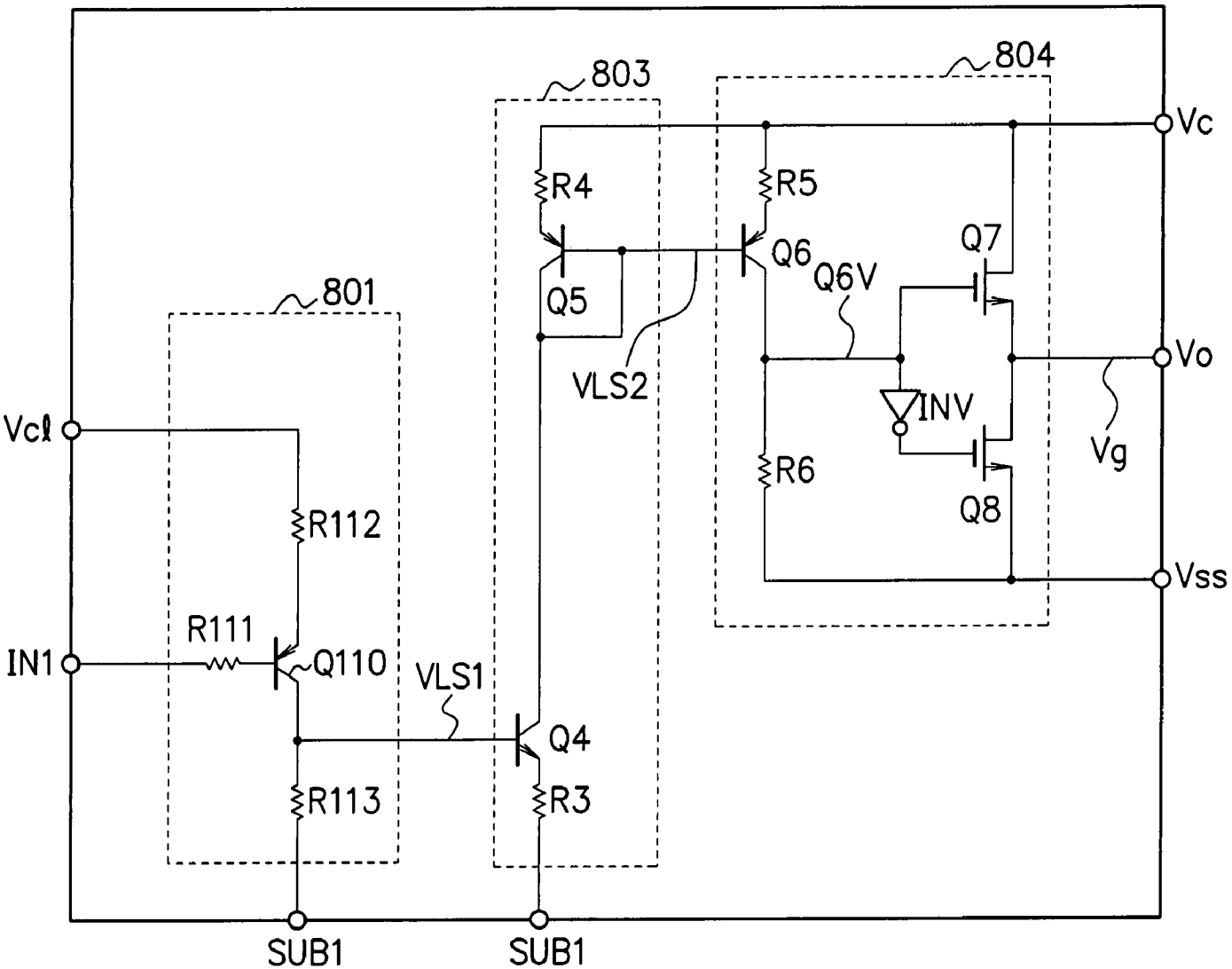
FIG. 11 is a diagram showing a circuit constitution example of a high level shift circuit and an output amplifying circuit.

FIG. 11 is a diagram showing a circuit constitution example of the low level shift circuit 801, the high level shift circuit 803 and the output amplifying circuit 804 shown in FIG. 8. The waveform processing circuit 802 may be deleted.

First, the constitution of the low level shift circuit 801 will be explained. In the npn transistor Q110, a base terminal is connected to the terminal of the input signal IN1 via the resistor R111, and an emitter terminal is connected to a voltage Vc1 (for example, 5V) via the resistor R112, and a collector terminal is connected to the terminal of the low level reference voltage SUB1 via the resistor R113. The collector terminal outputs a signal VLS1 to the high level shift circuit 803, and is connected to a base terminal of an npn transistor Q4.

As shown in FIG. 11, the high level shift circuit 803 is constituted of the npn transistor Q4, a pnp transistor Q5 and resistors R3 and R4. Here, the emitter terminal of the npn transistor Q4 is connected to the terminal of the low level reference potential SUB1 via the resistor R3. The collector terminal of the npn transistor Q4 is connected to a collector terminal of the pnp transistor Q5. A base terminal of the pnp transistor Q5 is connected to a base terminal of a pnp transistor Q6. An interconnection point of the collector terminal of the npn transistor Q4 and the collector terminal of the pnp transistor Q5 is connected to an interconnection point of a base terminal of the pnp transistor Q5 and a base terminal of the pnp transistor Q6. Thus, the high level shift circuit 803 outputs a transmission signal VLS2. An emitter terminal of the pnp transistor Q5 is connected to the power supply terminal Vc via the resistor R4.

Next, a circuit constitution of the output amplifying circuit 804 will be explained. As shown in FIG. 11, the output amplifying circuit 804 includes resistors R5 and R6, the pnp transistor Q6, an inverter INV, an n-channel MOSFET Q7 and n-channel MOSFET Q8. An emitter terminal of the pnp transistor Q6 is connected to the power supply terminal Vc via the resistor R5. A collector terminal of the pnp transistor Q6 is connected to the reference voltage terminal Vss via the resistor R6. An interconnection point of the collector terminal of the pnp transistor Q6 and the resistor R6 is connected to an input terminal of the inverter INV and a gate terminal of the n-channel MOSFET Q7.

A drain terminal of the n-channel MOSFET Q7 is connected to the power supply terminal Vc. A source terminal of the n-channel MOSFET Q7 is connected to a drain terminal of the n-channel MOSFET Q8. A gate terminal of the n-channel MOSFET Q8 is connected to an output terminal of the inverter INV. A source terminal of the n-channel MOSFET Q8 is connected to the reference voltage terminal Vss. An interconnection point of the source terminal of the n-channel MOSFET Q7 and the drain terminal of the n-channel MOSFET Q8 is connected to the output terminal Vo, and outputs a signal Vg for driving the switch SW1. According to the constitution shown above, thetransmission signal VLS2 is amplified to output the drive signal Vg to the gate terminal of the switch SW1.

Figure 12:
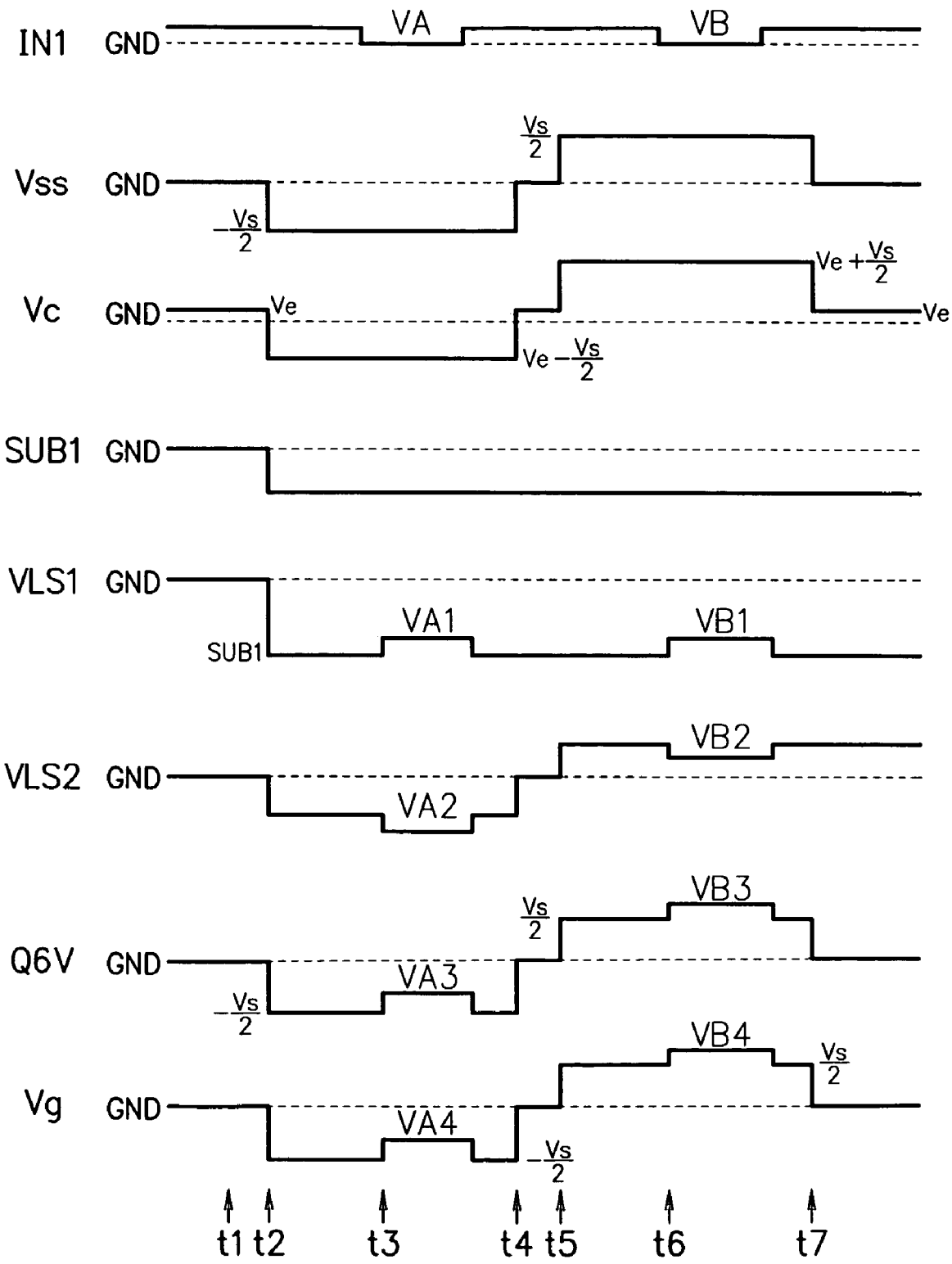
FIG. 12 is a diagram showing an input signal example and an output signal example of the circuits shown in FIG. 11.

FIG. 12 is a timing chart showing an operation of the circuit shown in FIG. 11. The input signal IN1 is a signal made by logically inverting the control signal for the switch SW1. Namely, in pulses VA and VB, the switch SW1 is turned ON. The signal IN1 may be logically inverted by using the inverter. The input signal IN1 has the reference potential at the ground (GND), and has the pulse VA and the pulse VB (for example, amplitude is 5V). The reference voltage terminal Vss corresponds to the signal line OUTA in FIG. 3, and changes from −Vs/2 (for example, −90V) to Vs/2 (for example, 90V). To simplify the explanation, the waveform of the reference voltage terminal Vss is shown by being simplified.

Here, the purpose for which the reference voltage terminal Vss performs a change shown in FIG. 12 will be explained. In the drive waveform of the display device shown in the aforementioned FIG. 15, it is necessary to perform sustain discharge by alternately applying the voltages (+Vs/2, −Vs/2) with different polarities from each other to the common electrode X and the scanning electrode Y in each display line. Therefore, the positive voltage +Vs/2 and the negative voltage −Vs/2 are alternately applied to the common electrode X of the load 20. Thus, the reference voltage Vss of the switch SW1 is changed from −Vs/2 to Vs/2.

First, when Vss=0V at the time t1, the SUB1 that is the output of the rectifying circuit (the diode D300 and the capacitor C300) shown in FIG. 8 is SUB1=0V, and Vc=Ve by the capacitor CE shown in FIG. 8. Since the input signal IN1=5V at the time t1, the pnp transistor Q110 is kept OFF. As a result, the output signal VLS1 of the low level shift circuit 801 is VLS1=0V. As a result, the npn transistor Q4 is OFF, and the pnp transistor Q5 is also OFF. As a result, the output signal VLS2 of the high level shift circuit 803 is VLS2≈Vc=Ve.

The pnp transistor Q6 is OFF since the signal VLS2≈Ve. As a result, Q6V that is the output signal of the pnp transistor Q6 is at the same potential as Vss. From this, the n-channel MOSFET Q7 is turned OFF, and the n-channel MOSFET Q8 is turned ON, whereby the output signal Vg of the output amplifying circuit 804 becomes Vg=0V.

Next, when Vss changes to Vss=−Vs/2 at the time t2, the charges with which the voltage becomes −Vs/2 are charged in the capacitor C300 of the rectifying circuit in FIG. 8, and the SUB1≈Vs/2 is established. The Vc=Ve−Vs/2 is established. At the time t2, the input signal remains in the state of IN1=5V, the pnp transistor Q110 is also kept OFF. As a result, the output signal VLS1 of the low level shift circuit 801 has the same voltage as the SUB1. Similarly, the npn transistor Q4 is temporarily tuned ON to make the collector terminal of the npn transistor Q4 have approximately the same voltage as the SUB1, and the npn transistor Q4 is turned OFF.

Next, the potential of the base terminal of the pnp transistor Q5 becomes SUB1≈Vs/2, and from the potential difference from the potential Vc=Ve−Vs/2 of the emitter terminal of the pnp transistor Q5, the pnp transistor Q5 is temporarily turned ON. Then, it is turned OFF at the point of time when the potential of the base terminal of the pnp transistor Q5 becomes approximately Vc=Ve−Vs/2. As a result, the output signal VLS2 of the high level shift circuit 803 becomes VLS2≈Ve−Vs/2. Next, since the signal VLS2≈Ve−Vs/2 is established, the pnp transistor Q6 is OFF. As a result, Q6V that is the output signal of the pnp transistor Q6 is at the same potential −Vs/2 as the Vss. From the above, the n-channel MOSFET Q7 is turned OFF while the n-channel MOSFET Q8 is turned ON, and therefore the output signal Vg of the output amplifying circuit 804 becomes Vg=−Vs/2.

Next, when the input signal IN1 becomes 0V by the pulse VA at the time t3, the pnp transistor Q110 is turned ON. As a result, the voltage value of the output signal VLS1 of the low level shift circuit 801 changes to the voltage value which is the voltage value between the SUB1 and the Vc1 and applied to the resistor R113, and forms the pulse VA1 (starting signal).

Next, the npn transistor Q4 is turned ON, whereby the pnp transistor Q5 is also turned ON. As a result of the above, the output signal VLS2 of the high level shift circuit 803 changes to the voltage value which is the voltage value between the SUB1 and the Vc(−Vs/2 to Ve−Vs/2) and applied to the resistor R3, and outputs the pulse VA2 (starting signal). Next, the pnp transistor Q5 is turned ON, whereby the pnp transistor Q6 is also turned ON. As a result, the Q6V which is the output signal of the pnp transistor Q6 changes to the voltage value between the SUB1 and the Vc (−Vs/2 to Ve−Vs/2) and the voltage value divided by the resistor R5 and the resistor R6 and forms the pulse VA3.

As a result of the above, the n-channel MOSFET Q7 is turned ON, while the n-channel MOSFET Q8 is turned OFF, and therefore the output signal Vg of the output amplifying circuit 804 is changed to Vg=Ve−Vs/2, and forms the pulse V4. When the pulse VA terminates (IN1 becomes 5V), each of the pulses VA1 to VA4 terminates, and the situation is returned to the state between the aforementioned time t2 and the time t3.

Next, at the time t4, when the Vss is returned to Vss=0V, the voltage of the capacitor C300 is kept at −Vs/2 by the operation of the diode D300 of the rectifying circuit in FIG. 8, and SUB1≈−Vs/2 is kept. At the time t4, Vc=Ve is established. The input signal IN1 remains to be IN1=5V at the time t4, and therefore the pnp transistor Q110 is kept OFF. As a result, the voltage value of the output signal VLS1 of the low level shift circuit 801 remains SUB1≈−Vs/2. Similarly, the npn transistor Q4 is also kept OFF.

Next, the pnp transistor Q5 is temporarily turned OFF due to the potential difference between the potential Vc=Ve, which is applied to the emitter terminal, and the potential Ve−Vs/2, which is applied to the base terminal. Then, at a point of time when the potential of the base terminal of the pnp transistor Q5 becomes approximately Vc=Ve, the pnp transistor Q5 is turned OFF. As a result, the output signal VLS2 of the high level shift circuit 803 becomes VLS2≈V3. Next, since the transmission signal VLS2≈Ve, the npn transistor Q6 is OFF. As a result, the Q6V, which is the output signal of the pnp transistor Q6, is at the same potential 0V as the Vss. As a result of this, the n-channel MOSFET Q7 is turned OFF while the n-channel MOSFET Q8 is turned ON, and therefore the output signal Vg of the output amplifying circuit 804 becomes Vg=0V.

As explained above, even when the reference potential GND of the input signal IN1 and the reference potential Vss (OUTA) at the time of driving the switch SW1 are different potentials, and the reference potential Vss is at the negative voltage value, excess current is prevented from flowing into a parasitic diode occurring between the substrate which supplies a low level reference potential as the substrate potential and the transistor, and a stable operation can be performed, by using the low level shift circuit 801, the high level shift circuit 803 and the output amplifying circuit 804.

Fifth Embodiment

Figure 9:
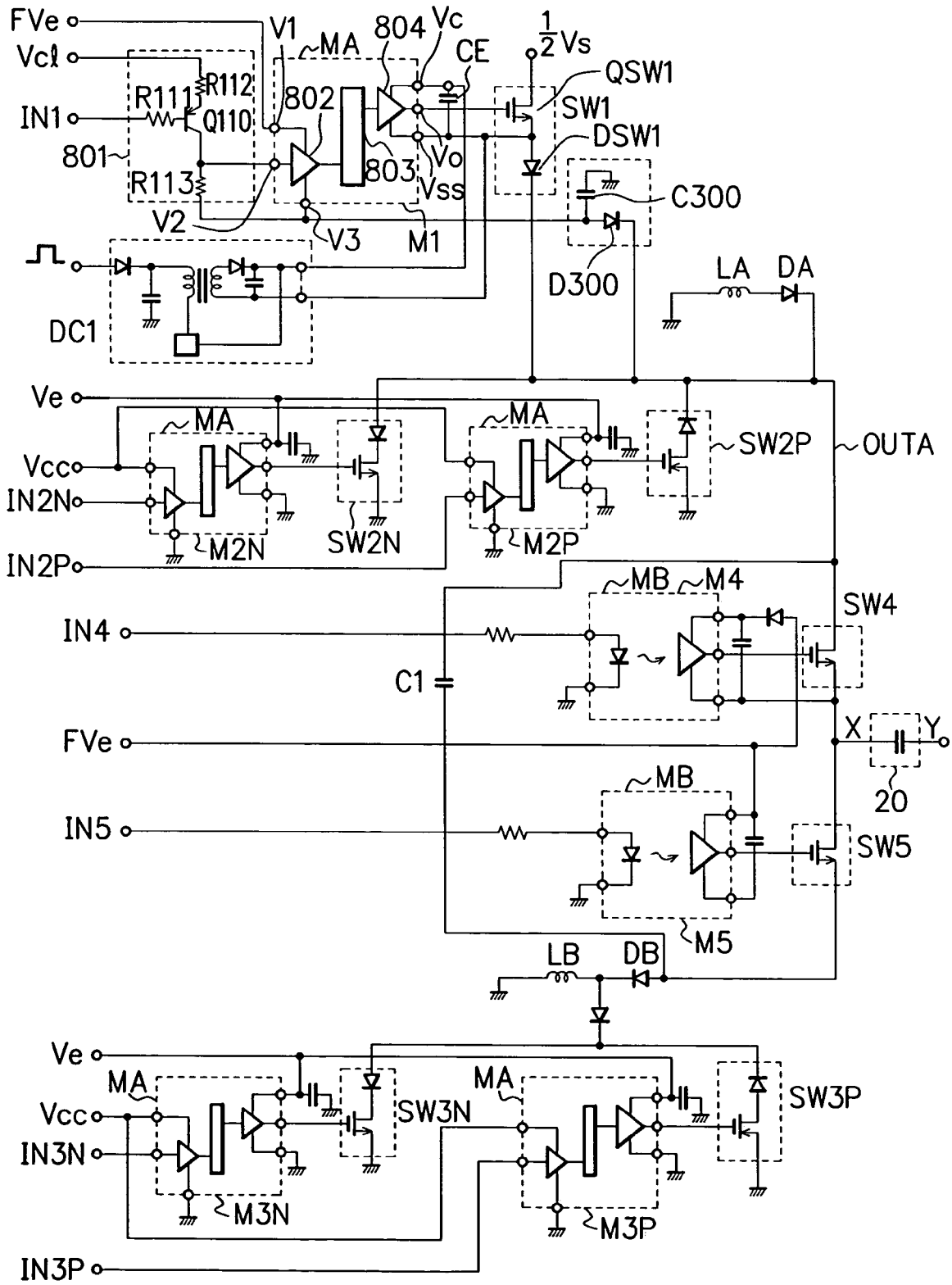
FIG. 9 is a diagram showing a fifth embodiment of the present invention.

FIG. 9 is a diagram showing a fifth embodiment of the present invention. As compared with FIG. 8, FIG. 9 differs in the point that the same DC/DC converter DC1 as in FIG. 6 is used as the floating power supply circuit instead of the switch SWE and the diode DE. As a result, the capacitance of the capacitor CE can be made smaller as compared with FIG. 8.

Sixth Embodiment

Figure 10:
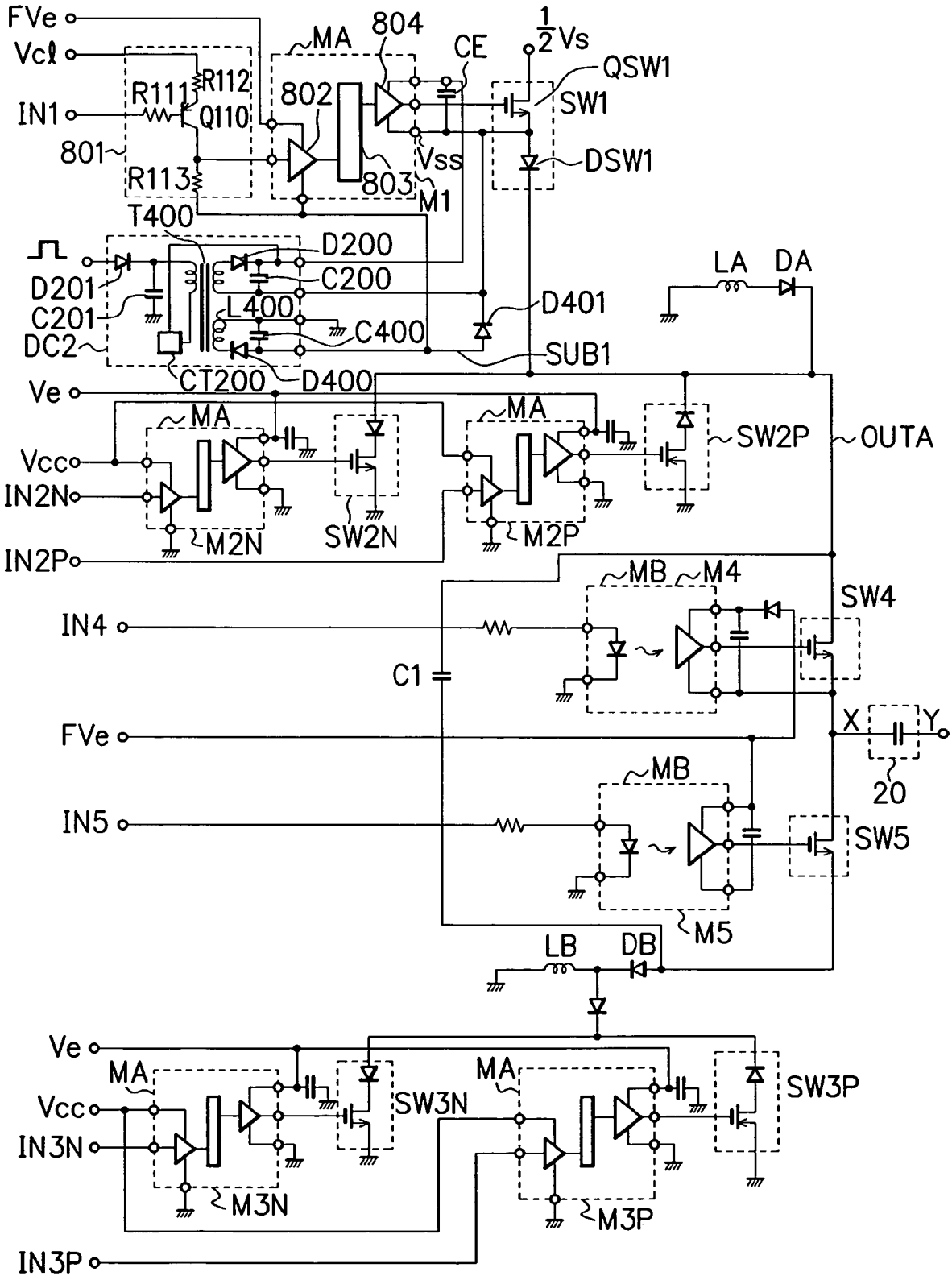
FIG. 10 is a diagram showing a sixth embodiment of the present invention.

FIG. 10 is a diagram showing a sixth embodiment of the present invention. As compared with FIG. 9, FIG. 10 differs in the point that the DC/DC converter DC1 which constitutes the floating power supply circuit is changed to a DC/DC converter DC2. The DC/DC converter DC2 differs from the DC/DC converter DC1 in the point that the low level reference voltage SUB1 is formed by adding wiring L400, a diode D400 and a capacitor C400 to the transformer T400. A low level shift circuit 801 performs level shift based on the low level reference voltage SUB1 generated by the DC/DC converter DC2. In the circuit shown in FIG. 10, the power supply voltage of the drive circuit which is supplied to the capacitor CE and the above-described low level reference voltage SUB1 are generated by using the same DC/DC converter DC2, but they may be generated respectively by using separate DC/DC converters. The low level reference voltage SUB1 generated by the above-described floating power supply circuit is set at a lower voltage than the lowest voltage which occurs to the signal line OUTA (for example, the lower voltage than negative pulse occurring in the period from t1 to t12 in FIG. 3).

As a result, the drive pulse for driving the transistor QSW1 can be supplied based on the input signal IN1. Even when the PN-junction type IC is used as the drive circuit MA constituted of the waveform processing circuit 802, the high level shift circuit 803 and the output amplifying circuit 804, there is no possibility of breakage by the aforesaid abnormal current or the like.

In a protection diode D401, the anode is connected to the terminal of the low level reference voltage SUB1 generated by the DC/DC converter DC2 and the cathode is connected to the reference terminal Vss of the drive circuit M1. Namely, the cathode is connected to the output signal line OUTA via the diode DSW1. The protection diode D401 is connected in the circuit shown in FIG. 10, so that the low level reference voltage SUB1 does not become lower than the output reference voltage (source voltage of the transistor QSW1) and does not cause a malfunction at a transition time such as the time of turning on the power supply, and the time of cutting off the power supply.

As described above, according to the first to the sixth embodiments, even when the output reference voltage Vss becomes negative voltage in the drive circuit as shown in FIG. 1 to FIG. 4, the signal transmission in the drive circuit M1 for driving the first switch SW1 for supplying the first potential Vs/2 to the first signal line OUTA can be reliably performed. Necessary drive pulse for gradually charging the capacitor C1 which is connected between the first signal line OUTA and the second signal line OUTB at the time of turning on the power supply can be supplied.

The plasma display device is explained in the above description, but the present invention can be applied to matrix type plane display devices other than this. The coil circuits A and B in FIG. 1 and FIG. 2 are respectively provided in the signal lines OUTA and OUTB, but the coil circuits are not limited to this, and only one coil circuit may be provided. It is suitable if only the coil circuit is connected between at least one of the signal lines OUTA and OUTB and the ground potential.

The first drive circuit can reliably drive the first switch element even when the voltage of the first signal line becomes negative voltage. The first capacitor which is connected between the first signal line and the second signal line can be gradually charged at the time of turning on the power supply. As a result, in the case of the plasma display device, a large amount of current can be prevented from flowing into the first switch element at the time of the start of the sustain discharge period.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

What is claimed is:

1. A drive circuit for a matrix type display device for applying predetermined voltage to a capacitive load being a display, comprising:

a first signal line for supplying a potential to one terminal of the capacitive load;

a first switch element for supplying a first potential to said first signal line;

a first drive circuit for driving said first switch element;

a second switch element for supplying a third potential to said first signal line;

a second signal line for supplying a second potential different from the first potential to the one terminal of the capacitive load;

a first capacitor connected between said first signal line and said second signal line and capable of supplying a lower potential than the first and the third potentials to said first signal line;

a third switch element for supplying the third potential to said second signal line;

a fourth switch element for connecting said first signal line to the one terminal of the capacitive load;

a fifth switch element for connecting said second signal line to the one terminal of the capacitive load;

a coil circuit connected between at least one of said first signal line and said second signal line, and a supply line for supplying the third potential; and a floating power supply circuit for supplying power supply voltage with potential of said first signal line as a reference to said first drive circuit.

2. The drive circuit according to claim 1, wherein said floating power supply circuit is constituted by using a power supply switch element, a diode, and a second capacitor.

3. The drive circuit according to claim 2, wherein said second capacitor is of 100 μF or more.

4. The drive circuit according to claim 2, wherein the power supply switch element is brought into conduction when the potential of said first signal line is the third potential.

5. The drive circuit according to claim 2, wherein said first drive circuit is constituted by using an optical transmitting element.

6. The drive circuit according to claim 5, wherein said first drive circuit is constituted by using a gate coupler.

7. The drive circuit according to claim 5, wherein said first drive circuit is constituted by using a photo coupler and an amplifying circuit for amplifying output voltage of the photo coupler.

8. The drive circuit according to claim 1, wherein said floating power supply circuit is constituted by using a DC/DC converter.

9. The drive circuit according to claim 8, wherein said first switch element is constituted by using a first transistor and a first diode, and a reference voltage of the DC/DC converter is voltage occurring to an output terminal of the first transistor.

10. The drive circuit according to claim 8, wherein the DC/DC converter is constituted by using a transformer.

11. The drive circuit according to claim 1, wherein said first drive circuit comprises a low level shift circuit for performing level shift for a reference potential of an input signal with the ground potential as a reference to a negative side, a high level shift circuit for performing level shift for a reference potential of an output signal of the low level shift circuit to a positive side, and an output amplifying circuit for amplifying an output signal of the high level shift circuit.

12. The drive circuit according to claim 11, wherein the low level shift circuit performs level shift for the reference potential of the input signal to a lowest potential or lower occurring to said first signal line.

13. The drive circuit according to claim 11, wherein the low level shift circuit performs level shift based on voltage resulted from rectifying voltage occurring to said first signal line.

14. The drive circuit according to claim 11, wherein said floating power supply circuit has a power supply switch element, a diode, and a capacitor.

15. The drive circuit according to claim 14, wherein the power supply switch element is brought into conduction when the potential of said first signal line is the third potential.

16. The drive circuit according to claim 11, wherein said floating power supply circuit is constituted by using a DC/DC converter.

17. The drive circuit according to claim 16, wherein said first switch element is constituted by using a first transistor and a first diode; and wherein reference voltage of the DC/DC converter is voltage occurring to an output terminal of the first transistor.

18. The drive circuit according to claim 16, wherein the DC/DC converter is constituted by using a transformer.

19. The drive circuit according to claim 11, wherein the low level shift circuit performs level shift based on low level reference voltage generated by the DC/DC converter.

20. The drive circuit according to claim 19, further comprising a protection diode with an anode being connected to a low level reference voltage terminal supplied with the low level reference voltage and a cathode being connected to said first signal line.

21. A plasma display device, comprising:

a plurality of X-electrodes;

a plurality of Y-electrodes disposed in parallel with said plurality of X-electrodes to generate discharge between said plurality of X-electrodes and the plurality of Y-electrodes;

an X-electrode driving circuit for applying discharge voltage to said plurality of X-electrodes; and a Y-electrode driving circuit for applying discharge voltage to said plurality of Y-electrodes, wherein at least either said X-electrode driving circuit or said Y-electrode driving circuit uses the drive circuit according to claim 1.

22. A drive circuit for a matrix type display device for applying predetermined voltage to a capacitive load being a display, comprising:

a first signal line for supplying a potential to one terminal of the capacitive load;

a first switch element for supplying a first potential to said first signal line;

a first drive circuit for driving said first switch element;

a second switch element for supplying a third potential to said first signal line;

a second signal line for supplying a second potential different from the first potential to the one terminal of the capacitive load;

a first capacitor connected between said first signal line and said second signal line and capable of supplying a lower potential than the first and the third potentials to said first signal line;

a third switch element for supplying the third potential to said second signal line;

a fourth switch element for connecting said first signal line to the one terminal of the capacitive load;

a fifth switch element for connecting said second signal line to the one terminal of the capacitive load;

a coil circuit connected between at least one of said first signal line and said second signal line, and a supply line for supplying the third potential; and a drive starting switch circuit connected in parallel with said first switch element, and brought into conduction when a power supply is turned on to charge said first capacitor.

23. The drive circuit according to claim 22, wherein said drive starting switch is in conduction for a period in which a potential of said first signal line becomes a predetermined potential from a ground potential.

24. The drive circuit according to claim 22, wherein said drive starting switch is constituted by using a p-channel MOS field effect transistor.

* * * * *

UNITED STATES PATENT AND TRADEMARK OFFICE

CERTIFICATE OF CORRECTION

PATENT NO. : 7,274,342 B2
APPLICATION NO. : 10/917399
DATED : September 25, 2007
INVENTOR(S) : Makoto Onozawa et al.

It is certified that error appears in the above-identified patent and that said Letters Patent is hereby corrected as shown below:

Title Page; item (74); First Page, Column 2 (Attorney, Agent, or Firm), Line 1, change "Stass" to --Staas--.

Signed and Sealed this

Twenty-ninth Day of April, 2008

JON W. DUDAS
*Director of the United States Patent and Trademark Office*